US006808871B2

(12) United States Patent
Suzuki et al.

(10) Patent No.: US 6,808,871 B2
(45) Date of Patent: Oct. 26, 2004

(54) SILVER HALIDE PHOTOGRAPHIC EMULSION

(75) Inventors: Katsuhiko Suzuki, Hino (JP); Yoshiko Iwai, Hino (JP)

(73) Assignee: Konica Corporation, Tokyo (JP)

( * ) Notice: Subject to any disclaimer, the term of this patent is extended or adjusted under 35 U.S.C. 154(b) by 2 days.

(21) Appl. No.: 10/266,482

(22) Filed: Oct. 8, 2002

(65) Prior Publication Data

US 2003/0162139 A1 Aug. 28, 2003

(30) Foreign Application Priority Data

Oct. 12, 2001 (JP) ..... 2001-315108

(51) Int. Cl.[7] ..... G03C 1/005; G03C 1/494

(52) U.S. Cl. ..... 430/567; 430/599; 430/600; 430/601; 430/603; 430/607

(58) Field of Search ..... 430/567, 599, 430/600, 601, 603, 607

(56) References Cited

U.S. PATENT DOCUMENTS

| | | | | | |
|---|---|---|---|---|---|
| 5,393,655 | A | * | 2/1995 | Sasaki et al. | 430/603 |
| 5,496,694 | A | * | 3/1996 | Kikuchi et al. | 430/567 |
| 5,498,516 | A | * | 3/1996 | Kikuchi et al. | 430/567 |
| 5,716,773 | A | * | 2/1998 | Nairne et al. | 430/600 |
| 6,316,176 | B1 | * | 11/2001 | Elst et al. | 430/603 |
| 6,632,595 | B2 | * | 10/2003 | Kikuchi et al. | 430/568 |
| 2003/0157447 | A1 | * | 8/2003 | Tanaka et al. | 430/603 |

* cited by examiner

*Primary Examiner*—Geraldine Letscher

(57) ABSTRACT

A silver halide emulsion is disclosed, comprising silver halide grains, wherein at least 50% of total grain projected area is accounted for by tabular grains having an aspect ratio of 10 to 100 and at least 50% by number of total grains is accounted for by tabular grains having at least 30 dislocation lines per grain in the fringe portion of the grain, and the emulsion contains a compound having a function of permitting injection of at least two electrons into silver halide via photoexcitation by a single photon.

8 Claims, No Drawings

SILVER HALIDE PHOTOGRAPHIC EMULSION

FIELD OF THE INVENTION

The present invention relates to photographic silver halide emulsions exhibiting enhanced sensitivity and improved sensitivity at low intensity exposure.

BACKGROUND OF THE INVENTION

Silver halide photographic light sensitive materials (hereinafter, also denoted simply as photographic materials) are said to be mature products having a high level of completeness, while various performance factors such as high sensitivity, enhanced image quality and improved storage stability are required and recently those requirements have been raised to higher levels. Specifically, with regard to high sensitivity and enhanced image quality, further enhanced performance is required to maintain superiority of silver halide photographic materials in view of recent technical progress in digital cameras.

To achieve higher sensitivity and enhanced image quality, there has been studied a technique for enhancing the ratio of sensitivity to grain size for respective grains in a silver halide emulsion (hereinafter, also denoted simply as an emulsion).

It is commonly known that silver halide grains contained in a silver halide emulsion have, in general, various shapes. Examples thereof include regular crystal silver halide grains such as cubic, octahedral or tetradecahedral grains, tabular silver halide grains having a single twin plane or plural parallel twin planes, and tetrapod-like or needle-like silver halide grains having non-parallel twin planes. Specifically, tabular silver halide grains (hereinafter, also denoted simply as tabular grains) are supposed to have the following advantages as photographic performance:

1. The ratio of grain volume to grain surface area (hereinafter, also denoted as its specific surface area) is relatively high, allowing a large amount of a sensitizing dye to be adsorbed onto the surface so that spectral sensitivity is high relative to intrinsic sensitivity;

2. When tabular grains containing emulsion are coated and dried, the tabular grains are arranged parallel to the support surface and thereby, the coating layer thickness can be reduced, leading to enhancement of sharpness of the photographic material;

3. Light scattering due to silver halide grains is relatively low, resulting in images with high resolution;

4. Sensitivity to blue light (intrinsic sensitivity) is relatively low so that when used in a green-sensitive or red-sensitive layer, the yellow filter density can be reduced or the yellow filter can be entirely removed from the constitution of a photographic material; and 5. In cases when having achieved the same sensitivity as commonly known other type grains, the characteristic grain shape results in a reduced silver coating amount, leading to enhancement of sensitivity/graininess ratio and superior resistance to natural radiation.

As prior art relating to tabular grains, preparation methods and utilizing techniques thereof are described in U.S. Pat. Nos. 4,434,226, 4,439,520, 4,414,310, 4,433,048, 4,414,306 and 4,459,353; JP-B Nos. 6-43605, 6-43606, 6-214331 and 6-222488 (hereinafter, the term, JP-B refers to Japanese Patent Publication); JP-A Nos. 6-43605, 6-43606, 6-214331, 6-2224888, 6-230493 and 6-258745 (hereinafter, the term, JP-A means Japanese Patent Application Publication).

To effectuate the foregoing advantages of tabular grains, it is effective to employ tabular grains having a higher aspect ratio. A technique used in combination with high aspect ratio tabular grains, as a technique for enhancing the ratio of sensitivity to grain size of silver halide grains is introduction of dislocation lines into those silver halide grains. Techniques for introducing dislocation lines, which are described in JP-A No. 63-220238, 1-102547, 6-27564 and 6-11781 are a sensitivity enhancing technique frequently employed in the photographic art. A tabular grain emulsion having a high aspect ratio and including dislocation lines may be said to be the arrival point of achievement for a high speed silver halide emulsion.

Recently, a compound exhibiting the function of injecting at least two electrons into silver halide through photoexcitation by a single photon is noted as a means for enhancing the sensitivity of a silver halide emulsion. In addition to doubling the number of electrons obtained by one photon, the compound contributes to an enhancement in sensitivity of the photographic emulsion by minimizing the loss process due to recombination of the formed electron with the oxidized dye or a positive hole. The function and reaction mechanism of the compound are detailed in Nature, 402, page 865 (1999); and J. Am. Chem. Soc., vol. 122, page 11934 (2000). There are also disclosed techniques employing this compound in U.S. Pat. Nos. 5,747,236, 6,010,841, 6,054,260, 6,153,371; and JP-A No. 11-237710. It was further found by the inventors of this application that addition of an organic compound capable of forming a cation with a valence of (m+n), i.e., an (m+n)-valent cation, from an n-valent cation radical with an intramolecular cyclization reaction (in which "n" and "m" are each an integer of 1 or more) resulted in a similar function.

Although techniques for enhancing sensitivity of silver halide grains are known as described above, there has been required a technique for improving sensitivity at low intensity exposure, which is needed at the time of photographing at a slow-shutter speed or in astrophotography, as well as sensitivity at ordinary intensity exposure.

SUMMARY OF THE INVENTION

Accordingly, it is an object of the present invention to provide a silver halide photographic emulsions exhibiting enhanced sensitivity and improved sensitivity at low intensity exposure.

The foregoing object can be accomplished by the following constitution:

1. A silver halide emulsion comprising silver halide grains, wherein at least 50% of total grain projected area is accounted for by tabular grains having an aspect ratio of 10 to 100 and at least 50% by number of total grains is accounted for by tabular grains having at least 30 dislocation lines per grain in the fringe portion of the grain, and the emulsion contains a compound having a function of permitting injection of at least two electrons into silver halide via photoexcitation by a single photon;

2. the silver halide emulsion described in 1. above, wherein the compound having a function of permitting injection of at least two electrons into silver halide through photoexcitation by a single photon is an organic compound capable of forming an (m+n)-valent cation, from an n-valent cation radical with an intramolecular cyclization reaction, in which "n" and "m" represent an integer of 1 or more;

3. the silver halide emulsion described in 1. or 2 above, wherein the silver halide grains have a shallow electron trap within the grain;

4. the silver halide emulsion described in 1. or 2. above, wherein the silver halide grains have a hole trap center within the grain.

DETAILED DESCRIPTION OF THE INVENTION

Silver halide emulsions relating to the invention are those comprising tabular silver halide grains (hereinafter, also denoted simply as tabular grains). The tabular grains are crystallographically classified as twinned crystal grains. The twinned crystal grains refer to crystal grains having at least one twinned plane within the grain. Classification of silver halide twinned crystal grains is described in Klein & Moisar's report (Photographishe Korrespondenz, vol. 99, page 99, and vol. 100, page 57). Tabular grains relating to the invention are those having at least two twinned planes parallel to the major faces.

The twin plane can be observed directly with a transmission electron microscope. Thus, a photographic emulsion is coated on a support to prepare a sample so that the major face of tabular grains contained are arranged parallel to the support surface. The thus prepared sample is cut using a diamond cutter to obtain ca. 0.1 μm thick slices. The presence of twin plane(s) can be confirmed through observation of this slice using a transmission electron microscope. In the invention, the spacing between two twin planes of the tabular grains is determined in such a manner that in the foregoing transmission electron microscopic observation of the slice, at least 100 tabular grains exhibiting a section vertical to the major faces are selected, then, the shortest spacing between two twin planes that are closest to the major face among even numbers of twin planes parallel to the major face is determined for each grain and the thus obtained shortest spacings are averaged for total grains to determine the spacing between twin planes as defined in the invention. The spacing between two twin planes (hereinafter, also called a twin plane spacing) is preferably not more than 0.01 μm.

One aspect of the silver halide emulsion of the invention is that at least 50% of the total grain projected area of the emulsion is accounted for by tabular grains having an aspect ratio of 10 to 100. Preferably, at least 60% of the total grain projected area, more preferably at least 70% and still more preferably at least 80% is accounted fro by tabular more preferably 10 to 50. The aspect ratio is defined as the ratio of grain diameter to grain thickness (i.e., aspect ratio=grain diameter/grain thickness) The grain diameter means the diameter of a circle having the same area as that of a grain projected vertically to the major face, i.e., projected area (hereinafter, also denoted as an equivalent circle diameter or abbreviated as ECD).

The diameter, thickness and aspect ratio of a tabular grain can be determined in the following manner (replica technique). Thus, a coating sample is prepared by coating silver halide grains and latex balls having a known diameter as an internal standard to prepare a sample on a substrate of a film support so that the major faces of the grains are arranged parallel to the substrate. After subjecting the sample to shadowing at a given angle by carbon vacuum evaporation, a replica sample is prepared by a conventional replica technique. An electron micrograph of this sample is taken and the projected area and thickness are determined for each grain using an image processing apparatus. In this case, the grain projected area can be calculated from the projected area of the internal standard and the grain thickness can also be calculated from the internal standard and the shadow length of the grain. In the invention, the average aspect ratio is an average value by number of aspect ratios of at least 30 grains.

In one preferred embodiment of the invention, a coefficient of variation (hereinafter, also denoted as a variation coefficient) of grain diameter (i.e., equivalent circle diameter) of total grains is less than 35%. This variation coefficient, which is a value indicating a grain size distribution or a degree of grain size dispersibility, is preferably less than 30% and more preferably less than 25%. The variation coefficient of equivalent circle diameter is a value defined in accordance with the following equation, which can be determined by the measurement of equivalent circle diameter of at least 300 grains randomly selected:

Variation coefficient of equivalent circle diameter (%)=(standard deviation of equivalent circle diameter)/(mean value of equivalent circle diameter)×100.

One aspect of the silver halide emulsion relating to the invention is that at least 50% by number of total grains is accounted for by tabular grains having at least 30 dislocation lines per grain, in the fringe portion of the grain. The tabular grains having at least 30 dislocation lines per grain in the fringe portion preferably accounts for at least 60% by number of the total grains, more preferably at least 70% by number, and still more preferably at least 80% by number. The number of dislocation lines per grain is preferably 30 to 1000, and more preferably 30 to 300.

The dislocation lines in silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are then placed on a mesh for electron microscopy. The sample is then observed by transmission electron microscopy, while being cooled to prevent the grain from being damaged by the electron beam. Since electron beam penetration is hampered as the grain thickness increases, sharper observations are obtained when using an electron microscope of higher voltage (e.g., at a voltage 200 kV or more for a 0.25 μm thick grain). From the thus-obtained electron micrograph, the position and number of the dislocation lines in each grain can be determined. Any of several methods for introducing the dislocation lines into the silver halide grain may be used.

In the invention, the expression "having dislocation lines in the fringe portion" means that the dislocation lines exist in the vicinity of the circumferential portion, in the vicinity of the edge or in the vicinity of the corner of the tabular grain. Concretely, when the tabular grain is observed vertical to the major face of the grain and a length of a line connecting the center of the major face (i.e., a center of gravity of the major face, which is regarded as a two-dimensional figure) and a corner is represented by "L", the fringe portion refers to the region outside the figure connecting points at a distance of 0.50L from the center with respect to the respective corners of the grain.

The dislocation lines can be introduced by various methods, in which, at a desired position of introducing the dislocation lines during the course of forming silver halide grains, an aqueous iodide (e.g., potassium iodide) solution is added, along with an aqueous silver salt (e.g., silver nitrate) solution by a double jet technique, only an iodide solution is added, an iodide-containing fine grain emulsion is added or an iodide ion releasing agent is employed, as disclosed in JP-A No. 6-11781.

Specifically, it is preferred to introduce dislocation lines into the silver halide grains relating to the invention by the use of an iodide ion releasing compound. The iodide ion releasing agent, which is a compound capable of releasing an iodide ion upon reaction with a base or a nucleophilic reagent is represented by the following formula:

R—I where R is a univalent organic group. R is preferably an alkyl group, alkenyl group, alkynyl group, aryl group, aralkyl group, heterocyclic group, acyl group, carbamoyl group, alkyloxycarbonyl group, aryloxycarbonyl group, alkylsulfonyl group, arylsulfonyl group, or sulfamoyl group. R is also preferably an organic group having 30 or less carbon atoms, more preferably 20 or less carbon atoms, and still more preferably 10 or less carbon atoms. R may be substituted by at least one substituent. The substituent may be further substituted. Preferred examples of the substituent include a halogen atom, alkyl group, aryl group, aralkyl group, heterocyclic group, acyl group, acyloxy group, carbamoyl group, alkyloxycarbonyl group, aryloxycarbonyl group, alkylsulfonyl group, arylsulfonyl group, or sulfamoyl group, alkoxy group, aryloxy group, amino group, acylamino group, ureido group, urethane group, sulfonylamino group, sulfinyl group, phosphoric acid amido group, alkylthio group, arylthio group, cyano, sulfo group, hydroxy, and nitro.

The iodide ion releasing agents (R—I) are preferably iodo-alkanes, a iodo-alcohol, iodo-carboxylic acid, iodo-amid, and their derivatives, more preferably iodo-amide, iodo-alcohol and their derivatives, still more preferably iodo-amide substituted by a heterocyclic group, and specifically preferable examples include (iodoacetoamido) bebzenesulfonat.

Preferred examples of the iodide ion releasing agent are shown below.

ID-1

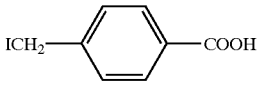

ID-2

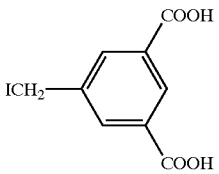

ID-3

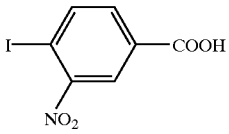

ID-4

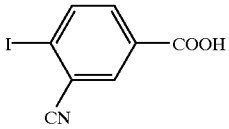

-continued

ID-5

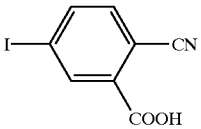

ID-6

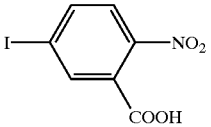

ID-7

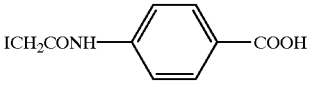

ID-8

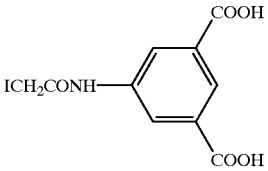

ID-9

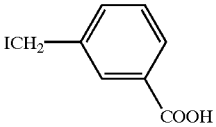

ID-10

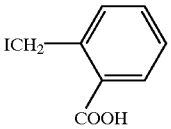

ID-11

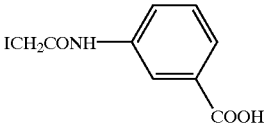

ID-12

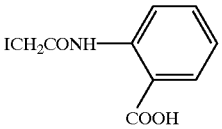

ID-13

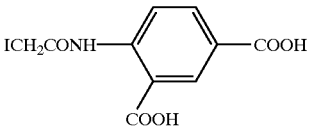

ID-14

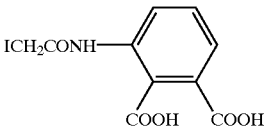

ID-15

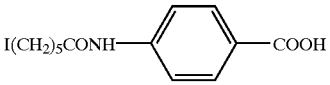

ID-16

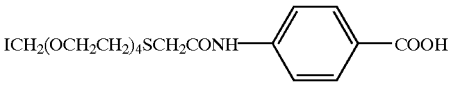

-continued
ID-17
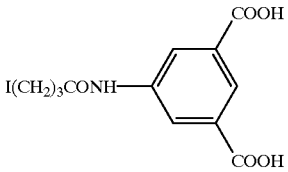
ID-18
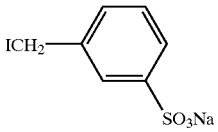
ID-19
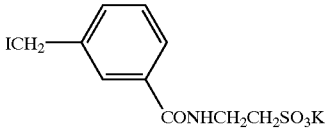
ID-20
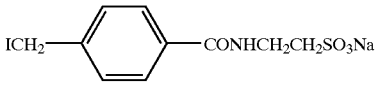
ID-21
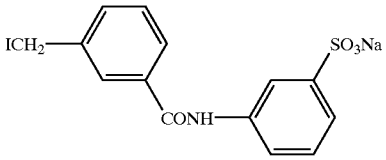
ID-22
$ICH_2CONHCH_2CH_2SO_3Na$
ID-23
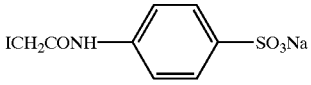
ID-24
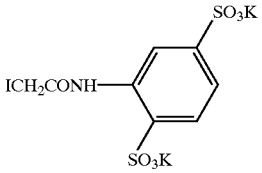
ID-25
$ICH_2CH_2SO_3Na$
ID-26
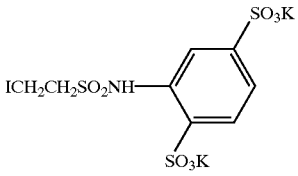
ID-27
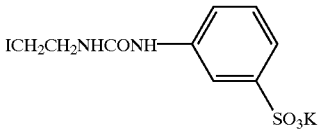
ID-28
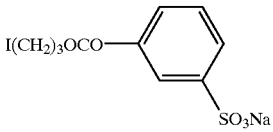
-continued
ID-29
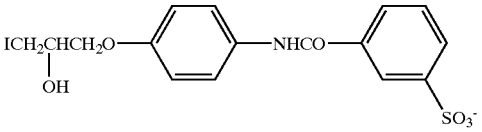
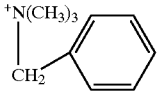
ID-30
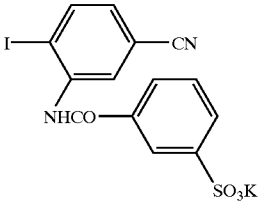
ID-31
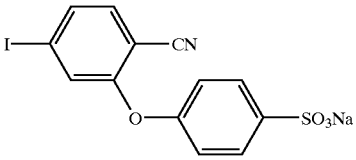
ID-32
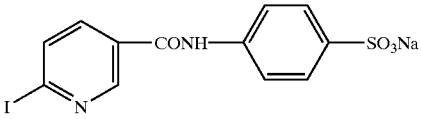
ID-33
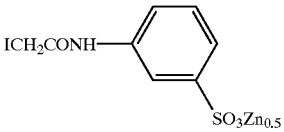
ID-34
$ICH_2CH_2OH$
ID-35
$I(CH_2)_3OH$
ID-36
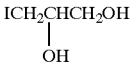
ID-37
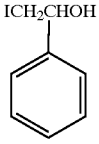
ID-38
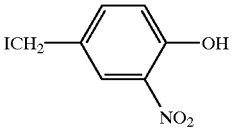
ID-39
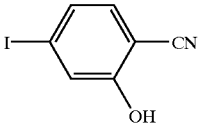

-continued
ID-40
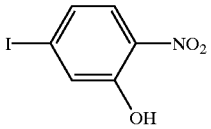
ID-41
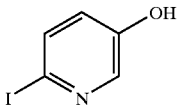
ID-42
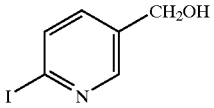
ID-43
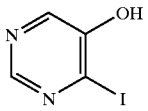
ID-44
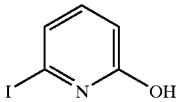
ID-45
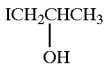
ID-46
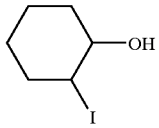
ID-47
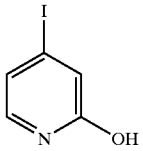
ID-48
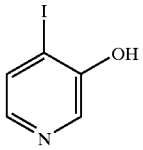
ID-49
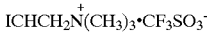
ID-50
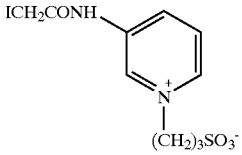
ID-51
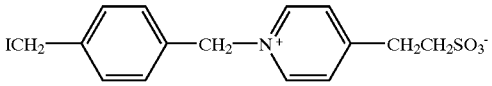
ID-52
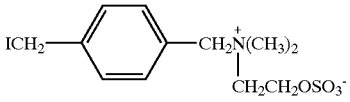
-continued
ID-53
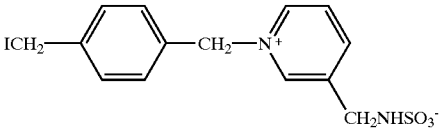
ID-54
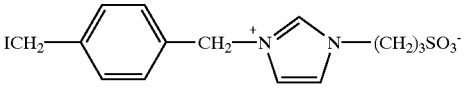
ID-55
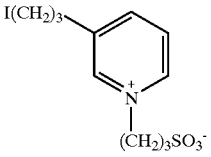
ID-56
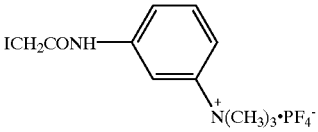
ID-57
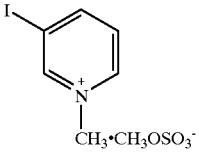
ID-58
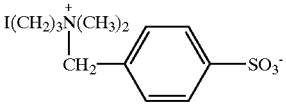
ID-59
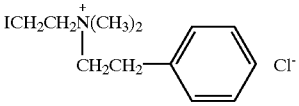
ID-60
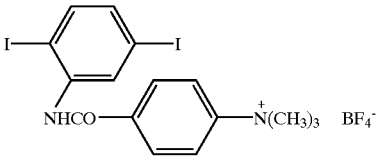
ID-61
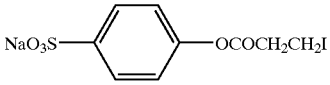
ID-62
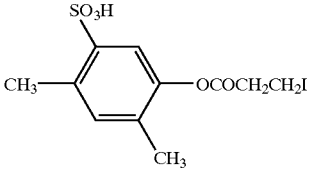
ID-63
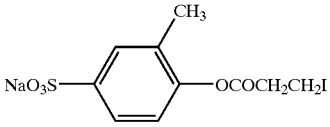

-continued
ID-64
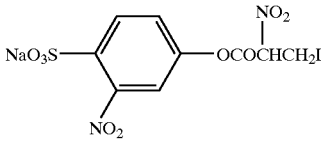
ID-65
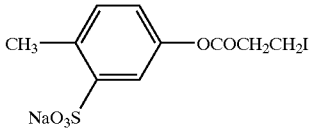
ID-66
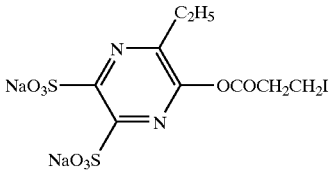
ID-67
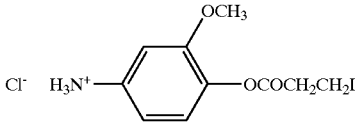
ID-68
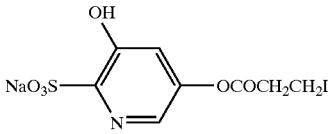
ID-69
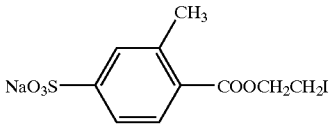
ID-70
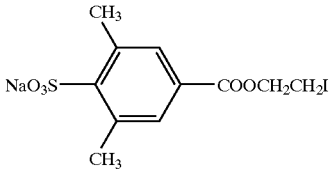
ID-71
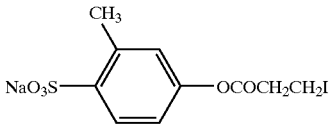
ID-72
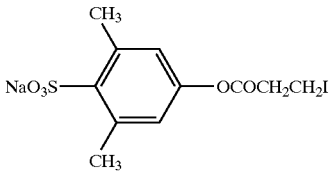
ID-73
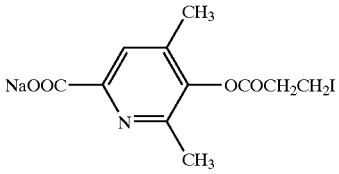
-continued
ID-74
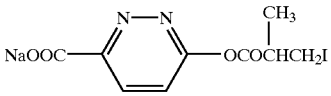
ID-75
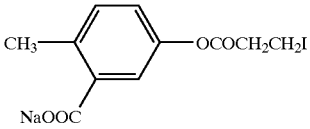
ID-76
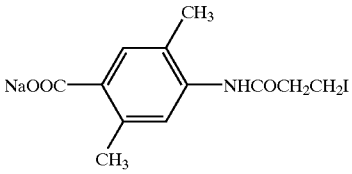
ID-77
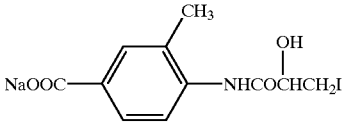
ID-78
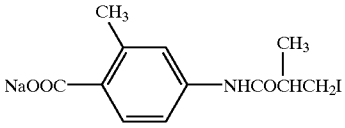
ID-79
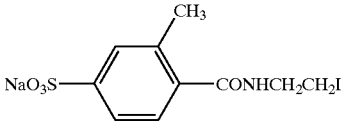
ID-80
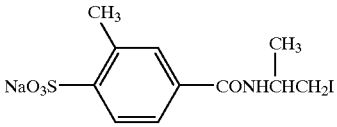
ID-81
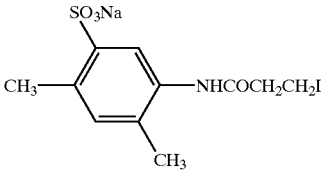
ID-82
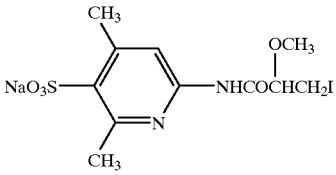
ID-83
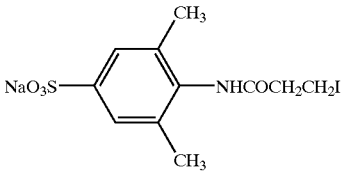

-continued
ID-84
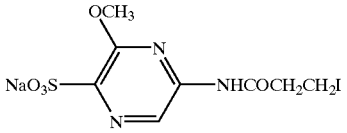
ID-85
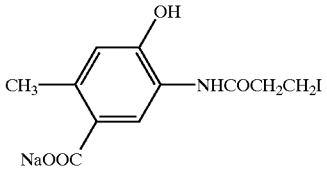
ID-86
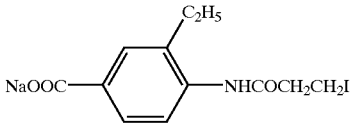
ID-87
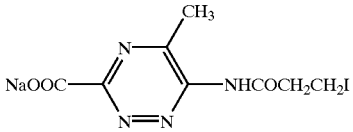
ID-88
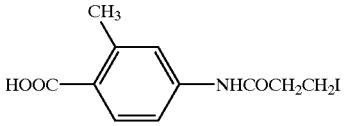
ID-89
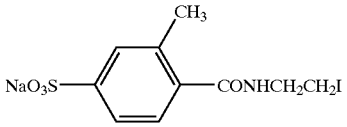
ID-90
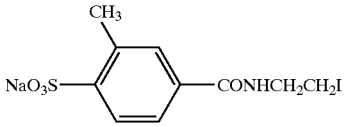
ID-91
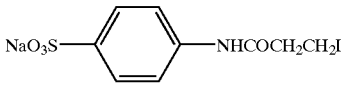
ID-92
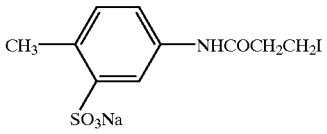
ID-93
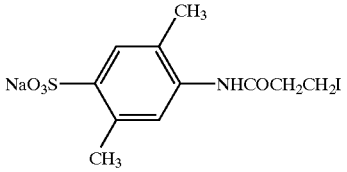
ID-94
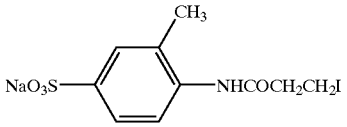
-continued
ID-95
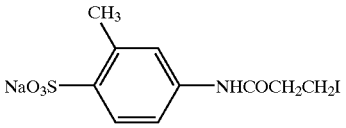
ID-96
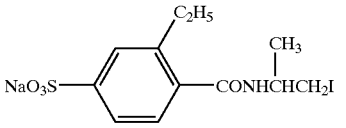
ID-97
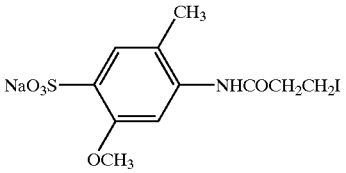
ID-98
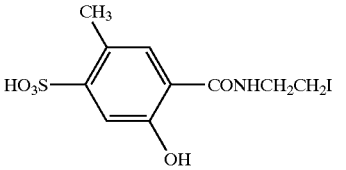
ID-99
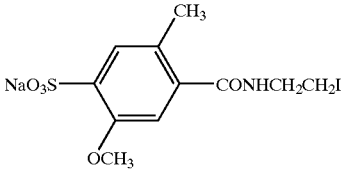
ID-100
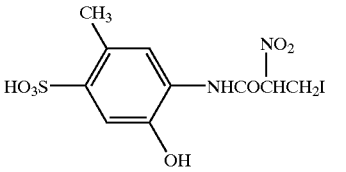
ID-101
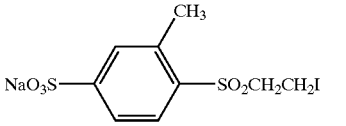
ID-102
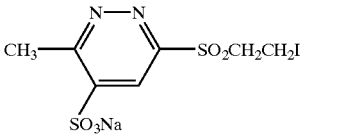
ID-103
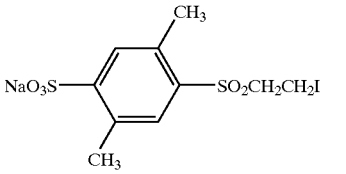

-continued

ID-104

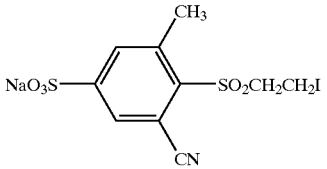

ID-105

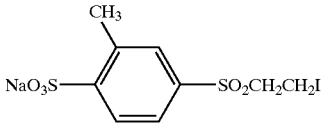

ID-106

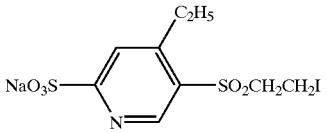

ID-107

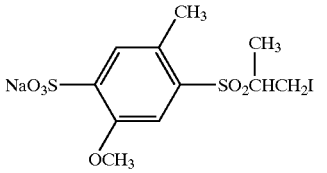

ID-108

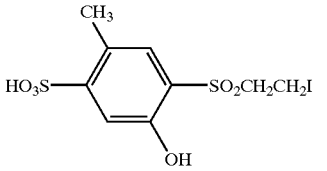

ID-109

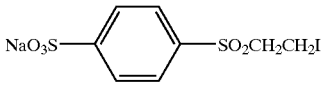

ID-110

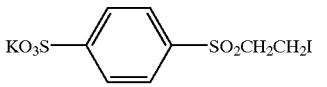

In cases when the iodide ion releasing agent is reacted with a nucleophilic agent (or nucleophile) to release an iodide ion, preferred nucleophilic agents include, for example, preferred nucleophilic agents include hydroxy ion, sulfite ion, thiosulfate ion, sulfonic acid ioncarboxylic acid ion, ammonia, amines, alcohols, ureas, thioureas, phenols, hydrazines, sulfides, and hydroxamic acids. Of these, hydroxy ion, sulfite ion, thiosulphate ion, sulfonic acid ion, carboxylic acid ion, ammonia and amines are more preferred, and hydroxy ion and sulfite ion are specifically preferred.

When dislocation lines are introduced into silver halide emulsion grains using the iodide ion releasing agent, preferred reaction conditions are as follows. Thus, the reaction temperature is preferably 30 to 80° C., and more preferably 40 to 70° C. The pAg immediately before introduction of dislocation lines is preferably 7.0 to 10.0, and more preferably 7.5 to 9.5. The iodide ion releasing agent is added preferably in an amount of 1 to 5 mol %, based on the total amount of silver halide. The pH at the time of an iodide ion releasing reaction is preferably 7.0 to 11.0, and more preferably 8.0 to 10.0. In cases when a nucleophilic agents other than a hydroxy ion, the amount thereof is preferably 0.25 to 2.0 times, more preferably 0.5 to 1.5, and still more preferably 0.8 to 1.2 times that of the iodide ion releasing agent.

In the invention, the silver halide emulsion contains a compound having a function of permitting injection of at least two electrons into silver halide through photoexcitation caused by absorption of a single photon. In conventional photographic emulsions, a sensitizing dye is excited through excitation by absorption of a single photon, whereby a single electron is injected into the conduction band of silver halide, forming an oxidized sensitizing dye. It is supposed that repeating this process forms a developable, stable center, called a latent image. Even in an emulsion containing no sensitizing dye, similarly, excitation by a single photon forms a single electron in the conduction band and a positive hole is concurrently formed in the valence band. After having injected a single electron into the conduction band of silver halide through excitation by a single photon, the above-described compound exhibits the function of reacting with the oxidized sensitizing dye or the hole in the valence band to inject one more electron into the conduction band of silver halide. In addition to doubling the number of electrons obtained by one photon, the compound contributes to an enhancement in sensitivity of the photographic emulsion by minimizing the loss process due to recombination of the formed electron with the oxidized dye or a positive hole. The function and reaction mechanism of the compound are detailed in Nature, 402, page 865 (1999); and J. Am. Chem. Soc., vol. 122, page 11934 (2000).

The foregoing compound having a function of permitting injection of at least two electrons into silver halide through photoexcitation by a single photon preferably is an organic compound capable of forming a cation having a valence of (m+n), i.e., an (m+n)-valent cation, from a cation radical having a valence of n (i.e., an n-valent cation radical) with an intramolecular cyclization reaction, in which n and m each represent an integer of 1 or more.

Specifically, n and m preferably are each 1 and an organic compound forming a bivalent cation with an intramolecular cyclization reaction is more preferred. The intramolecular cyclization reaction preferably is a reaction accompanied with bridged ring formation.

The organic compound capable of forming a (m+n)-valent cation from an n-valent cation radical with an intramolecular cyclization reaction is preferably a compound represented by the following formula (1), (2) or (3):

$$A^1—X^1—B^1—X^2—A^2 \qquad \text{formula (1)}$$

wherein $X^1$ and $X^2$ are each independently N atom, P atom, S atom, Se atom or Te atom; $A^1$ and $A^2$ are each independently a substituent; and $B^1$ is a bivalent linkage group;

formula (2)

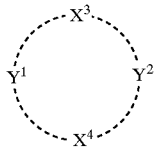

wherein $X^3$ and $X^4$ are each independently N atom, P atom, S atom, Se atom or Te atom; $Y^1$ and $Y^2$ are each an atomic group necessary to form together with $X^3$ or $X^4$ a 6- to 12-membered ring, and in the ring formed by $X^3$, $X^4$, $Y^1$ and $Y^2$, ring-forming atoms other than $X^3$ and $X^4$ are preferably carbon atoms;

$$(Z—)_{k1}—[—(—L—)_{k3}—X]_{k2} \qquad \text{formula (3)}$$

wherein Z is an adsorption group onto silver halide (or group promoting adsorption onto silver halide grains) or light absorbing group; L is a bivalent linkage group; X is a group having a moiety structure of the compound capable of forming a (m+n)-valent cation from an n-valent cation radical with an intramolecular cyclization reaction, group having a moiety structure of formula (1) or a group having a moiety structure of formula (2): k1 is an integer of 1 through 4, k2 is an integer of 1 through 4, and k3 is 0 or 1.

The light absorbing group, represented by "Z" of formula (3) can be synthesized in accordance with methods described in F. M. Hamer "Heterocyclic Compounds-Cyanine Dyes and Related Compounds", (John Wirey & Sons, New York, 1964); D. M. Sturmer, Heterocyclic Compounds-Special Topics in Heterocyclic Chemistry", chapter 18, sect. 14, pages 482–515 (John Wiley & Sons, New York and London, 1977); "Rodd's Chemistry of carbon Compounds" 2nd Ed. vol. IV, part B, 1977, pages 369–422 (Elsevier Science Publishing Co. Inc., New York). The adsorption group onto silver halide, represented by Z of formula (3) can also be synthesized in accordance with methods described in U.S. Pat. No. 5,538,843, page 16, line 37 to page 17, line 29.

A linkage forming reaction of the linkage group represented by $B^1$ of formula (1) or by L of formula (3) can be accomplished employing methods commonly known in organic chemistry, i,e., bond forming reaction such as an amido-bond forming reaction and ester bond forming reaction. These synthesis reactions are referred to "SHIN-JIKKEN KAGAKU KOHZA No. 14, Synthesis and Reaction of Organic Compounds" vol. I to V (Maruzen, Tokyo, 1977), Y. Ogata "YUKIHANNORON" (MARUZEN, tOKYO, 1962); L. F. Fieser, M. Fieser, Advanced Organic Chemistry (Maruzen, Tokyo, 1962).

The light absorbing group represented by "Z" of formula (3) may be any methine dye, and preferred emples thereof include a cyanine dye, merocyanine dye, rhodacyanine dye, three-nucleus merocyanine dye, holopolar dye, hemicyanine dye and styryl dye.

The adsorption group onto silver halide, represented by "Z" of formula (3) may be anyone and preferably contains at least one of nitrogen, sulfur, phosphorus, selenium and tellurium atoms. The adsorption group onto silver halide may be a silver ligand, which is capable of coordinating with a silver ion on the silver halide grain surface or a cationic surfactant. Examples of the silver ligand include a sulfur acid and selenium or tellurium analogs (which is analogous to the sulfur acid), nitrogen acid, thioester and selenium or tellurium analogs (which is analogous to the thioester), phosphorus, thioamido, selenaamide, telluruamide and carbon acid. The foregoing acid compounds are preferably those exhibiting an acid dissociation constant (pKa) of 5 to 14. More preferably, the silver ligand promotes adsorption of the compound represented by formula (3) onto silver halide. The sulfur acid is preferably a mercaptan or thiol, which can form together with a silver ion a double salt. A thiol having a stable C—S bond is used as an adsorption group onto silver halide, not as a sulfide ion precursor (see, "The Theory of the Photographic Process" page 32–34 (1977). There are used saturated or unsaturated alkyl- or arylthiol and selenium or tellurium analogs, having a structure of R"—SH or R""—SH, in which R" represents an aliphatic group, aromatic group or heterocyclic group (which is preferably substituted by a group including a halogen, oxygen, sulfur or nitrogen atom; R"" represents an aliphatic group, aromatic group or heterocyclic group. R"" may be substituted by a sulfonyl group, in which R""—SH represents a thiosulfonic acid group.

Preferred examples of the adsorption group, represented by "Z" are shown below, but are by no means limited to these.

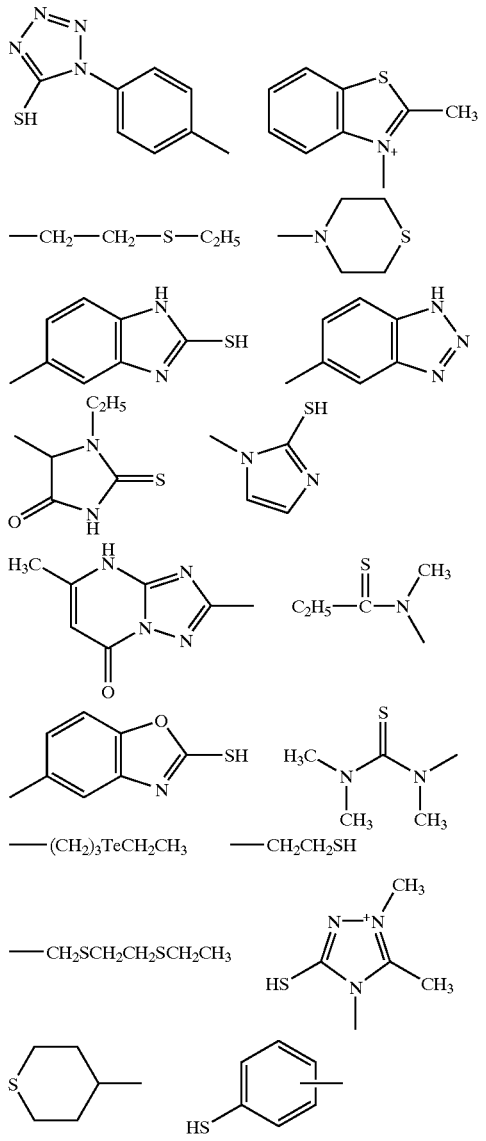

The $B^1$ of formula (1) or the L of formula (3) represents a bivalent linkage group. The linkage group preferably is comprised of an atom or an atomic group including at least one selected from carbon, nitrogen, sulfur and oxygen atoms. The linkage group is preferably a 1 to 20 carbon bivalent linkage group comprised of one selected from an alkylene group (e.g., methylene, ethylene, propylene, butylenes, pentylene), arylene group (e.g., phenylene, naphthylene), alkenylene group (e.g., ethenylene, propenylene), alkynylene (e.g. ethynylene, propynylene), amido group, ester group, sulfoamido group, sulfonic acid ester group, ureido group, sulfonyl group, sulfinyl group, thio-ether group, ether group, carbonyl group, —N(Ra)— (in which Ra represents a hydrogen atom, a substituted or unsubstituted alkyl group or a substituted or unsubstituted aryl group), and bivalent heterocyclic group (e.g., 6-chloro-1,3,5-triazine-2,4-di-yl, pyridine-2,4-di-yl, quinoxaline-2,3-di-yl), or the combination thereof. The linkage group is more preferably one selected from a 1 to 10 carbon bivalent linkage group comprised of one selected from an alkylene group having 1 to 4 carbon atoms (e.g., methylene, ethylene, propylene, butylenes), arylene group having 6 to 10 carbon atoms (e.g., phenylene, naphthylene), alkenylene group having 1 to 4 carbon atoms (e.g., ethenylene, propenylene) and and alkynylene having 1 to 4 carbon atoms (e.g. ethynylene, propynylene) and the combination thereof. Exemplarily, the following linkage groups are preferred:

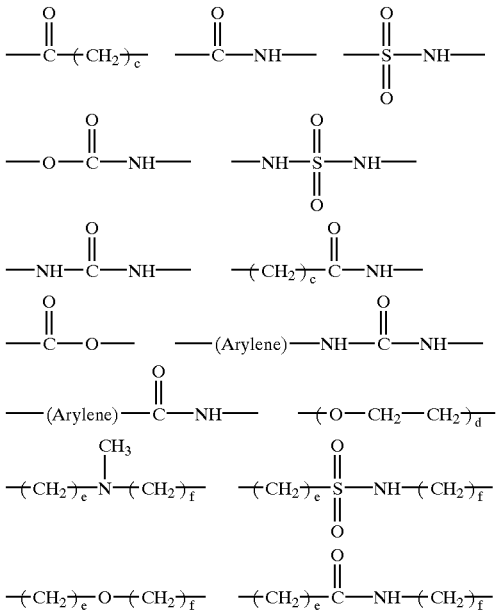

-continued

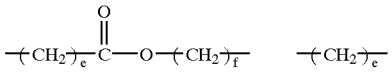

where subscript, "c" is an integer of 1 to 30 (preferably 3 to 10), "d" is an integer of 1 to 10 (preferably 3 to 10); "e" and "f" are each an integer of 1 to 30, provided that the sum of "e" and "f" are not more than 30.

In formula (1), $A^1$ and $A^2$ each independently represent a substituent group. Examples thereof include a halogen atom, a mercapto group, cyano group, carboxyl group, phosphoric acid group, sulfo group, hydroxy group, carbamoyl group, sulfamoyl group, nitro group, alkoxy group, aryloxy group, acyl group, acyloxy group, acylamino group, sulfonyl group, sulfinyl group, amino group, substituted amino group, ammonium group, hydrazine group, ureido group, imido group, arylthio group, alkoxycarbonyl group, aryloxycarbonyl group, substituted or unsubstituted alkyl group, cycloalkyl group, unsaturated hydrocarbon group, substituted or unsubstituted aryl group, and heterocyclic group.

The compounds used in the invention, represented by formulas (1), (2) and (3) can be readily synthesized in accordance with methods described in J. Org. Chem. 48, 21, 1983, 3703–3712; J. Heterocycl. Chem. 28, 3, 1991, 573–575; Tetrahedron, 49, 20, 1993, 4355–4364; and Chem. lett. 12, 1990, 2217–2220. The compounds represented by formula (1), (2), and (3) may be used alone but are preferably used in combination with spectral sensitizing dyes.

Exemplary examples of the compounds used in the invention, represented by formulas (1), (2) and (3) are shown below but are by no means limited to these.

T-1

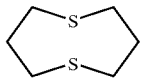

T-2

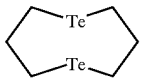

T-3

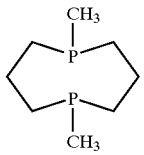

T-4

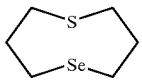

T-5

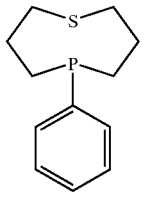

T-6

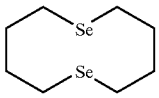

T-7

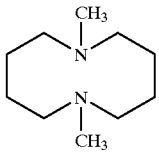

T-8

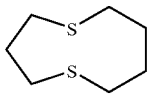

T-9

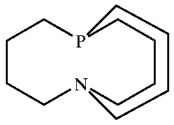

T-10

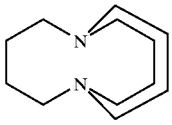

-continued
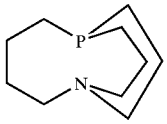
T-11
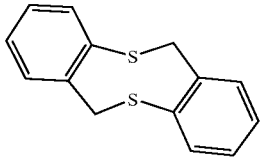
T-12
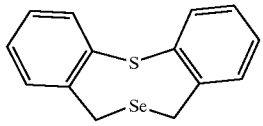
T-13
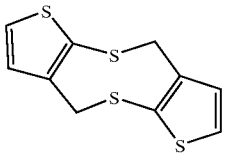
T-14
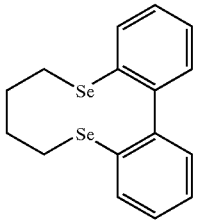
T-15
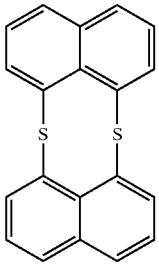
T-16
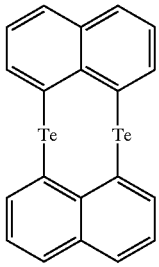
T-17
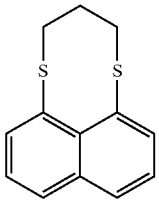
T-18
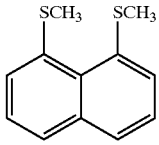
T-19
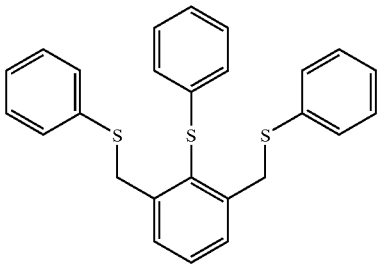
T-20
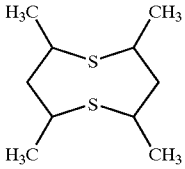
T-21
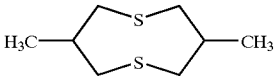
T-22
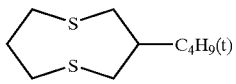
T-23
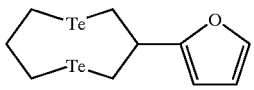
T-24
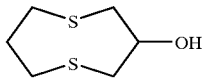
T-25
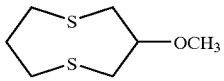
T-26

-continued
T-27
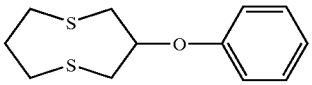
T-28
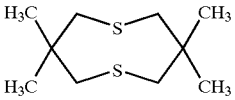
T-29
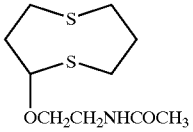
T-30
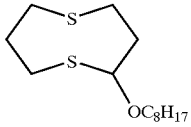
T-31
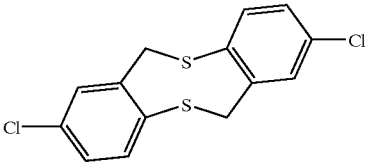
T-32
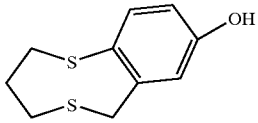
T-33
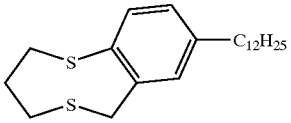
T-34
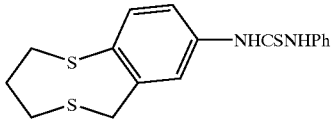
T-35
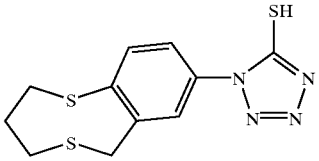
T-36
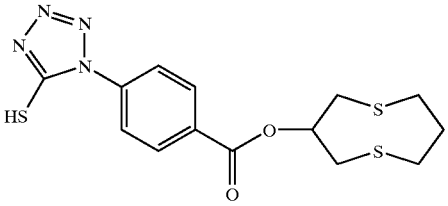
T-37
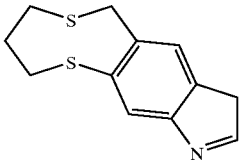
T-38
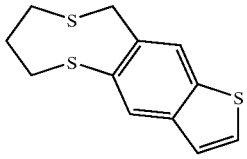
T-39
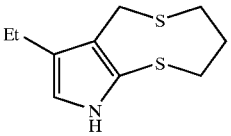
T-40
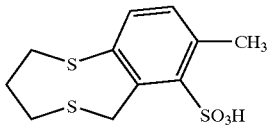
T-41
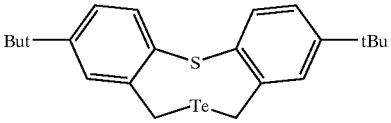
T-42
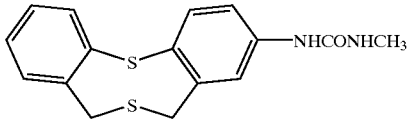
T-43
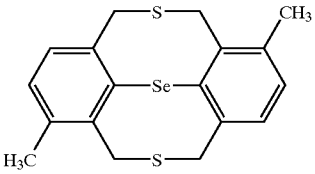
T-44
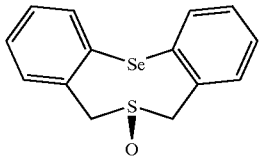

-continued
T-45
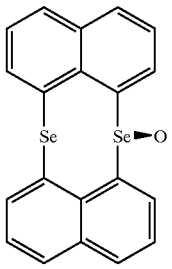
T-46
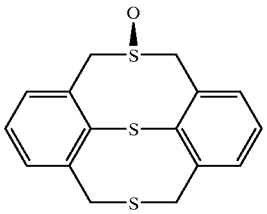
T-47
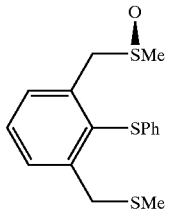
T-48
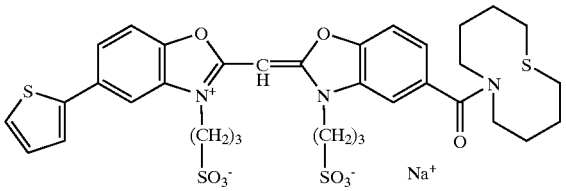
T-49
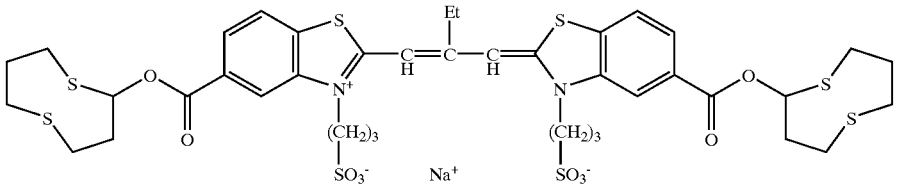
T-50
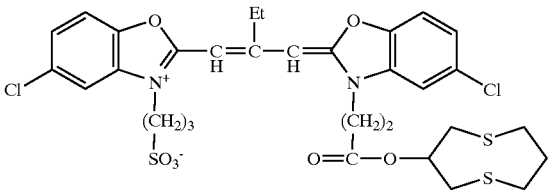
T-51
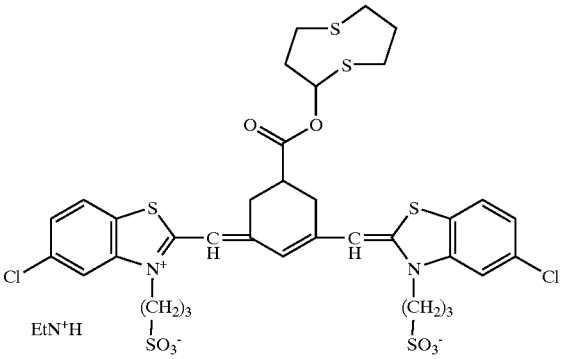
T-52
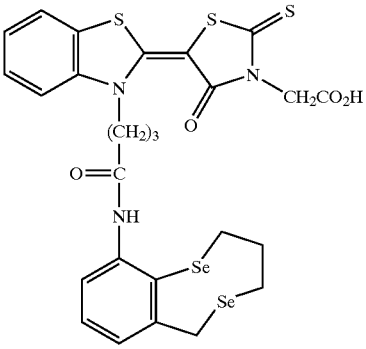
T-53
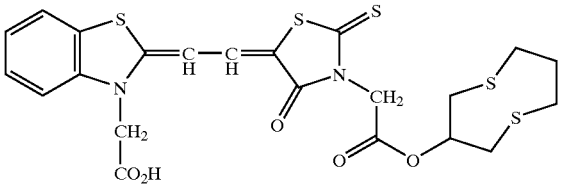

-continued

T-54

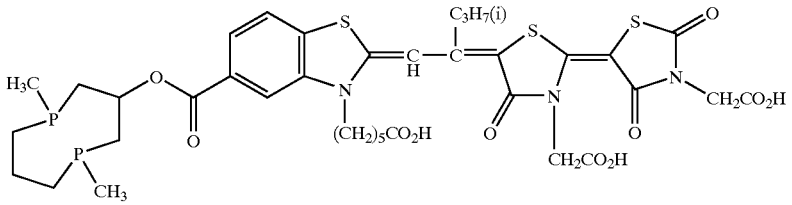

Exemplified compound (T-1), for example, forms a bivalent cation according to the following reaction scheme:

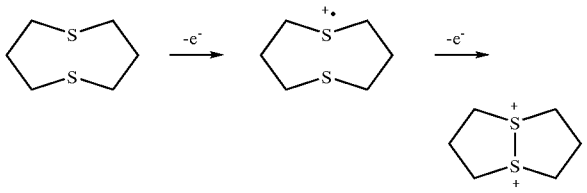

The compounds represented by formulas (1), (2) and (3) can be incorporated into silver halide emulsions or photographic materials, alone or in combination with other addenda. The compounds may be added to a silver halide emulsion at any stage of emulsion making. As described in U.S. Pat. Nos. 2,735,766, 3,628,960, 4,183,756, 4,225,666; JP-A Nos. 58-184142, and 60-196749, for example, the compound may be added during formation of silver halide grains, before, during desalting, or after desalting and before starting chemical ripening, as described in JP-A No. 58-113920, immediately before or during chemical ripening, or after chemical ripening and before emulsion coating. As described in U.S. Pat. No. 4,225,666 and JP-A No. 58-7629, The compound, alone or in combination with a compound different in structure, may be fractionally added, for example, during the stage of grain formation and during the stage of or after completion of chemical ripening, or before or during chemical ripening and after chemical ripening. The compound is added preferably after completion of spectral sensitization and chemical sensitization, and before addition of a stabilizer.

The organic compound capable of forming a (m+n)-valent cation from an n-valent cation radical with an intramolecular cyclization reaction may be incorporated in any amount. In case of the compound having no adsorption group onto silver halide, the amount is preferably $10^{-5}$ to $10^{-1}$ mol per mol of silver halide; and in case of the compound having adsorption group onto silver halide, the amount is preferably $10^{-6}$ to $10^{-2}$ mol per mol of silver halide.

The silver halide emulsion relating to the invention preferably contains a hydroxybenzene compound. Such a hydroxybenzene compound is exemplarily shown below:

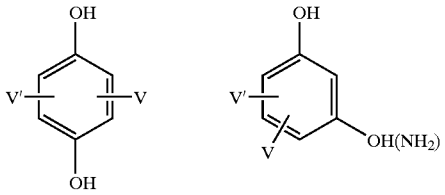

-continued

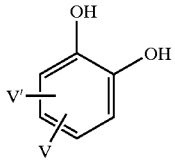

wherein V and V' are each independently —H, —OH, a halogen atom, —OM (in which M is an alkali metal ion), alkyl group, phenyl group, amino group, carboxyl group, carbonyl group, sulfone group, sulfonated phenyl group, sulfonated alkyl group, sulfonated amino group, carboxyphenyl group, hydroxyphenyl group, carboxyalkyl group, carboxyamino group, hydroxyphenyl group, hydroxyalkyl group, alkyl ether group, alkyl phenyl group, alkyl thioether group or phenyl thioether group. Of these are preferred —H, —OH, —Cl, —Br, —COOH, $—CH_2CH_2COOH$, $—CH_3$, $—CH_2CH_3$, $—(CH_3)_3$, $—OCH_3$, —CHO, $—SO_3Na$, $—SO_3H$, $—SCH_3$ and phenyl group.

Specifically preferred hydoxybenzene compounds are as follows:

HB1

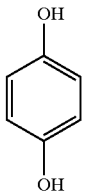

HB2

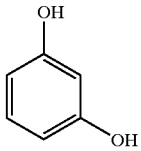

HB3

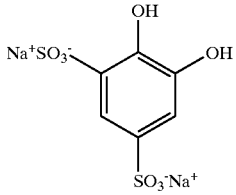

HB4

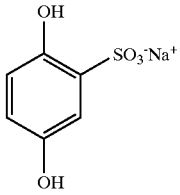

-continued

HB5

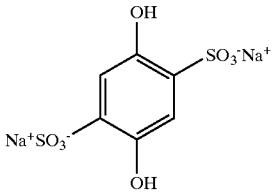

HB6

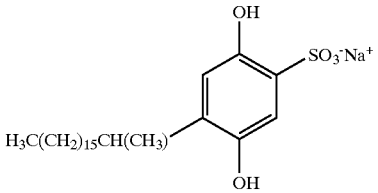

HB7

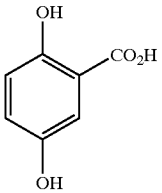

HB8

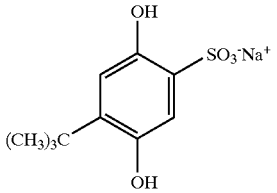

HB9

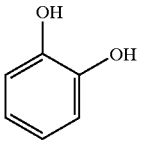

HB10

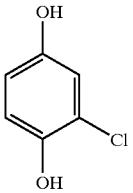

HB11

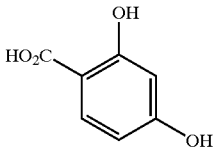

HB12

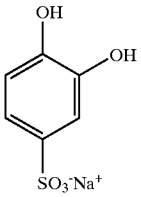

-continued

HB13

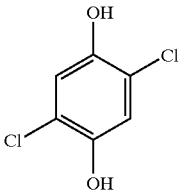

HB14

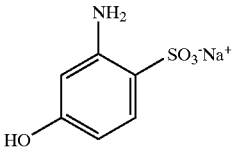

HB15

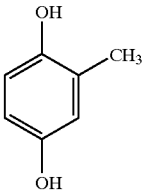

Further to the foregoing, compounds represented by general formulas (IV-1) and (IV-2) of JP-A No. 2001-42466 are also include and as exemplary compounds thereof are preferably used compounds IV-1-1 through IV-2-4 disclosed in col. 0191 through 0224 of JP-A 2001-42466. The foregoing hydroxybenzene compound may be incorporated in the emulsion layer relating to the invention or any component layer of the photographic material relating to the invention. The compound is added preferably in an amount of $1\times10^{-3}$ to $1\times10^{-1}$ mol, and more preferably $1\times10^{-3}$ to $2\times10^{-2}$ mol per mol of silver halide.

In the silver halide grain emulsion relating to the invention, silver halide grains preferably have a shallow electron trap center in the interior of the grain. The shallow electron trap center can be provided by doping a dopant represented by the following formula into the silver halide grains:

$$[ML_6]^n$$

where M represents a polyvalent metal ion having a filled frontier orbital and $L_6$ represents independently six coordination complex ligands, provided that at least four of the ligands (L6) are anion ligands and at least one of the ligands is a ligand more electron-negative than a halide ligand (in other words, the ligand exhibiting a electronnegativity higher than that of a halide ligand); and n is a negative integer (and preferably, −1, −2, −3 or −4). The polyvalent metal ion having a filled frontier orbital (or filled frontier orbital polyvalent metal ion) is preferably $Fe^{+2}$, $Ru^{+2}$, $Os^{+2}$, $Co^{+3}$, $Rh^{+3}$, $Ir^{+3}$, $Pd^{+4}$ or $Pt^{+4}$. Sensitizing effects produced by the shallow electron trap center and techniques for providing the shallow electron trap center to silver halide grains by means of a dopant are described in Research Disclosure (hereinafter, also denoted simply as RD) No. 36736 and U.S. Pat. No. 5,728,517. Examples of the dopant providing a shallow electron trap center include SET-1 through SET-27 described in U.S. Pat. No. 5,728,517, and SET-28 through SET-33, as shown below:

SET-1: $[FE(CN)_6]^{4-}$

SET-2: $[Ru(CN)_6]^{4-}$

SET-3: $[Os(CN)_6]^{4-}$

SET-4: $[Rh(CN)_6]^{3-}$
SET-5: $[Ir(CN)_6]^{3-}$
SET-6: $[Fe(pyrazine)(CN)_5]^{4-}$
SET-7: $[RuCl(CN)_5]^{4-}$
SET-8: $[OsBr(CN)_5]^{4-}$
SET-9: $[RhF(CN)_5]^{3-}$
SET-10: $[IrBr(CN)_5]^{3-}$
SET-11: $[FeCO(CN)_5]^{3-}$
SET-12: $[RuF_2(CN)_4]^{4-}$
SET-13: $[OsCl_2(CN)_4]^{4-}$
SET-14: $[RhI_2(CN)4_5]^{3-}$
SET-15: $[IrBr_2(CN)4]^{3-}$
SET-16: $[Ru(CN)_5(OCN)]^{-4}$
SET-17: $[Ru(CN)_5(N_3)]^{-4}$
SET-18: $[Os(CN)_5(SCN)]^{4-}$
SET-19: $[Rh(CN)_5(SeCN)]^{3-}$
SET-20: $[Ir(CN)_5(HOH)]^{2-}$
SET-21: $[Fe(CN)_3Cl_3]^{3-)}$
SET-22: $[Ru(CO)_2(CN)_4]^{1-}$
SET-23: $[Os(CN)\ (CN)_5]^{-4}$
SET-24: $[Co(CN)_6]^{3-}$
SET-25: $[Ir(CN)_4(oxalate)_2]^{3-}$
SET-26: $[In(NCS)_6]^{3-}$
SET-27: $[Ga(NCS)_6]^{3-}$
SET-28: $[Co(NO_2)_6]^{3-}$
SET-29: $[Ire(NO_2)_6]^{3-}$
SET-30: $InCl_3$
SET-31: $Ga(NO_3)_3$
SET-32: TlCl
SET-33: $Pb(NO_3)_2$.

Examples of the ligand (L) include $CN^-$, CO, $NO_2^-$, 1,10-phenathroline, 2,2'-bipyridine, $SO_3^-$, ethylenediamine, $NH_3$, pyridine, $H_2O$, $NCS^-$, $NCO^-$, $O_3^-$, $SO_4^-$, $OH^-$, $N_3^-$, $S_2^-$, $F^-$, $Cl^-$, $Br^-$, and $I^-$. Furthermore, examples of preferred dopants include those described in JP-A 2002-214733, paragraph [0035].

The dopant may be added in the form of a solution or a fine silver halide grain emulsion doped with a dopant. The dopant is added in an amount of $10^{-6}$ to $10^{-3}$ mol, and preferably $10^{-5}$ to $10^{-4}$ mol per mol of silver halide. The dopant is added preferably after forming at least 50% (and more preferably at least 70%) of the grown (or final) grain volume. The dopant is also added preferably at a pAg of 7.5 to 9.5, and more preferably 8.0 to 9.0.

The silver halide emulsion relating to the invention may contain polyvalent metals compound as a dopant other than the foregoing dopant providing a shallow electron trap center (i.e., shallow electron trapping dopant). Preferred metal compounds, used as a dopant include, for example, those of Mg, Al, Ca, Sc, Ti, V, Cr, Mn, Fe, Co, Ni, Cu, Zn, Ga, Ge, Sr, Y, Zr, Nb, Mo, Tc, Ru, Rh, Pd, Cd, Sn, Ba, Ce, Eu, W, Re, Os, Ir, Pt, Hg, Tl, Pd, Bi and In. The metal compound to be doped is used preferably in the form of a single salt or a metal complex. The metal complex preferably is a six, five, four or two coordination complex and an octahedral six coordination complex or a planar four coordination complex is more preferred. The metal complex may be a mononuclear or polynuclear complex. Examples of ligands constituting the complex include $CN^-$, CO, $NO_2^-$, 1,10-phenanthroline, 2,2'-bipirydine, $SO_3^-$, ethylenediamine, $NH_3$, pyridine, $H_2O$, $NCS^-$, $NCO^-$, $NO_3^-$, $SO_4^-$, $OH^-$, $CO_3^{2-}$, $SSO_3^{2-}$, $N_3^-$, $S_2^-$, $F^-$, $Cl^-$, $Br^-$ and $I^-$. In the case of $NCS^-$, either the N-atom or S-atom can coordinate.

The silver halide emulsion preferably comprises silver halide grains having a hole trap center in the interior of the grain. The hole trap center can be provide by conducting reduction sensitization at the stage of grain formation. The reduction sensitization can be conducted by adding a reducing agent to a silver halide emulsion or a solution used for grain growth. Alternatively, the silver halide emulsion or solution used for grain growth is ripened or mixed at a low pAg of 7 or less or at a high pH of 7 or more. These procedures may be conducted singly or in combination thereof. Specifically, addition of a reducing agent is preferred.

Examples of preferred reducing agents include thiourea dioxide (formamidine-sulfonic acid), ascorbic acid and its derivatives, and tin (II) salt. Other reducing agents include, for example, borane compounds, hydrazine compounds, silane compounds, amines and polyamines. The reducing agent is added preferably in an amount of $10^{-8}$ to $10^{-2}$ mol, and more preferably $10^{-6}$ to $10^{-4}$ mol per mol of silver halide. Silver salts, and preferably water-soluble silver salts are added to perform ripening at a low pAg. The water soluble silver salt is preferably silver nitrate. The ripening is carried out at a pAg of not more than 7, preferably not more than 6, and still more preferably 1 to 3 (in which the pAg is $-\log[A^+]$ or logarithmic reciprocal of the silver ion concentration). The ripening at a high pH is carried out by adding an alkaline compound to a silver halide emulsion or a solution used for grain growth. Examples of the alkaline compound include sodium hydroxide, potassium hydroxide, potassium carbonate, and ammonium. In cases when ammoniacal silver nitrate is used in the grain formation, alkaline compounds other than ammonia are used to avoid lowered effect of ammonia.

Reducing agents, silver salts or alkaline compounds may be added instantaneously or added over a period of a given time to perform reduction sensitization, in which the addition thereof may be conducted at a constant flow rate or at an accelerated flow rate. The addition may be dividedly carried out. Prior to addition of a water-soluble silver salt and/or water-soluble halide to a reaction vessel, the foregoing compounds may be allowed to exist therein. The compound may be mixed with a halide solution and added together with the halide. The compound may be added separately from the water-soluble silver salt and halide.

To control the formation of the hole trap center, it is preferred to add, after completion of reduction sensitization, a compound capable of releasing a chalcogen ion (hereinafter, also denoted as a chalcogen ion releasing compound).

Such a chalcogen ion releasing compound is preferably a compound releasing a sulfide ion, selenide ion, or telluride ion. Preferred examples of the compound releasing a sulfide ion include a thiosulfonic acid compound, disulfide compound, thiosulfate compound, sulfide compound and thiosemicarbazide compound, thioformamide compound and a rhodanine compound. Preferred compounds releasing a senium ion are those which are commonly known as a selenium-sensitizing agent. Examples thereof include colloidal selenium, isoselenocyanates (e.g., allyl isoselenocyanate), selenoureas (e.g., N,N-dimethylselenourea, N,N,N'-triethylselenourea, N,N,N'-trimethyl-N'-heptafluoropropylselenourea, N,N,N'-trimethyl-N'-heptafluoropropylcarbonylselenourea, N,N,N'-trimethyl-N'-4-nitrophenylcarbonylselenourea), selenoketones (e.g., selenoacetoamide, N,N-dimethylselenobenzamide), selenophosphates (e.g., tri-p-triselenophosphate), and selenides (e.g., diethylselenide, diethyldiselenide, triethylphosphine selenide). Examples of the compound releasing a telluride ion include telluroureas (e.g., N,N-dimethyltellurourea, tetramethyltellurourea, N-carboxyethyl-N,N'-dimethyltellurourea), phosphine tellurides (e.g., tributylphosphine telluride, tricyclohecylphosphine telluridetriisopropylphosphine telluride), telluroamides (e.g., telluroacetoamide, N,N-dimethyltellurobenzamide), telluroketones, telluroesters, and isotellurocyanates. Of the foregoing chalcogen ion releasing compounds, thiosulfonic acid compounds are preferred.

The chalcogen ion releasing compound is added preferably in an amount of $10^{-8}$ to $10^{-2}$ mol, and more preferably $10^{-6}$ to $10^{-3}$ mol per mol of silver halide. The chalcogen ion releasing compound may be added instantaneously or added over a period of a given time to perform reduction sensitization, in which the addition thereof may be conducted at a constant flow rate or at an accelerated flow rate. The addition may be dividedly carried out. Addition of the chalcogen ion releasing compound must be conducted before completing grain formation.

The silver halide emulsion is preferably comprised of silver halide grains having a multi-layered structure comprising plural layers different in halide composition. It is preferred to have at least three layers, more preferably at least four layers, and still more preferably at least five layer different in halide composition. Adjacent layers are different in halide composition ratio by at least 1 mol %, and more preferably different in iodide content by at least 1 mol %.

In the preparation of silver halide emulsions relating to the invention, it is preferred to apply ultrafiltration to concentrate an emulsion by ultrafiltration in at least a part of the grain growth stage. In cases when preparing tabular grain emulsions having a relatively high aspect ratio and exhibiting high homogeneity in grain size distribution, such as in the invention, it is preferred to grow grains in a diluted environment so that application of the ultrafiltration is preferable to enhance productivity. When conducting concentration of emulsions by using ultrafiltration, it is also preferred to employ a manufacturing facility of silver halide emulsions, as described in JP-A No. 10-339923.

The silver halide emulsions used in the invention contain a dispersion medium. The dispersion medium is a compound capable of acting as a protective colloid for silver halide grains. It is preferred to allow the dispersion medium to be present from the start of the nucleation stage to completion of grain growth stage. Preferred examples of the dispersion medium include gelatin and hydrophilic colloids. There is preferably used gelatin such as alkali or acid processed gelatin having a molecular weight of the level of 100,000 or enzyme-treated gelatin described in Bull. Soc. Sci. Photo. Japan No. 16, pp. 30 (1966). Examples of the hydrophilic colloid include gelatin derivatives, graft polymers of gelatin and other polymers, proteins such as albumin and casein, cellulose derivatives such as hydroxyethyl cellulose, carboxymethyl cellulose, cellulose sulfuric acid ester, saccharide derivatives such as sodium alginate and starch derivatives and synthetic hydrophilic polymer material including homopolymers such as polyvinyl alcohol, polyvinyl alcohol partial acetal, poly(N-vinyl pyrrolidine), polyacrylic acid, polymethacrylic acid, polyacrylamide, polyvinyl imidazole, and polyvinyl pyrazolo, and their copolymers.

At the stage of nucleation of silver halide grains, it is preferred to use oxidized gelatin, low molecular weight gelatin having a molecular weight of 10,000 to 50,000 and oxidized low molecular weight gelatin. Specifically is preferred an oxidized gelatin, in which methionine residue is reduced by oxidation to a level of less than 30 $\mu$mol per gram of gelatin. At the stage of grain growth is preferable oxidized gelatin, in which methionine residue is reduced by oxidation to a level of less than 20 $\mu$mol, and more preferably less than 10 mol % per gram of gelatin. Oxidation of alkali-processed gelatin by using oxidizing agents is useful to achieve a methionine content of less than 30 $\mu$mol/g. Oxidizing agents to oxidize gelatin include, for example, hydrogen peroxide, ozone, peroxy-acid, halogen, thiosulfonic acid compounds, quinines, and organic peracids. Of these, hydrogen peroxide is preferred. Determination of the methionine content is described in many literatures. Amino acid analysis, HPLC method, gas chromatography and silver ion titrimetry are employed with reference to, for example, Journal of Photographic Science, vol. 28, page 11; ibid, vol. 40, page 149; ibid, vol. 41, page 172; ibid, vol. 42, page 117; and Journal of Imaging Science and Technology, vol. 39, page 367.

At the stage of grain growth is preferable oxidized gelatin, in which methionine residue is reduced by oxidation to a level of less than 20 $\mu$mol per gram of gelatin. Chemically modified gelatins include, for example, gelatin, an amino group of which is substituted, as described in JP-A Nos. 5-72658, 9-197595 and 9-251193.

In the emulsion relating to the invention, after completion of silver halide grain growth, soluble salts may be or may not be removed. Desalting can also be conducted at any time during the silver halide grain growth, in such a manner as described in JP-A No. 60-138538. Soluble salts can be removed in accordance with methods described in RD17643, item II. Thus, to remove soluble salts from the emulsion after forming precipitates or completing physical ripening, there may be employed a noodle washing method by chill-setting gelatin or a coagulation washing (flocculation) by using inorganic salts, anionic surfactants, anionic polymers (e.g., polystyrene sulfonic acid, etc.) or gelatin derivatives (e.g., acylated gelatin, carbamoylated gelatin, etc.).

The emulsion of the invention may be used alone in an emulsion layer or may be blended with other emulsion(s) within the range not vitiating effects of the invention. The use of plural emulsions different in average size in the same emulsion layer is one of preferred embodiments.

In emulsion making, conditions other than the foregoing can be optimally selected with reference to JP-A Nos. 61-6643, 61-14630, 61-112142, 62-157024, 62-18556, 63-92942, 63-151618, 63-163451, 63-220238, and 63-311244; RD38957, items I and III, and RD40145, item XV.

In the construction of a color photographic material using the emulsion of the invention, the emulsion having been subjected to physical ripening, chemical ripening and spectral sensitization is used. Additive used in such manufacturing processes are described in RD38957, items IV and V, and RD40145, item XV. Commonly known photographic additives usable in the invention are also described in RD38957, items II through X and RD40145, items I through XIII.

In the constitution of a color photographic material using the silver halide emulsion relating to the invention, red-, green- and blue-sensitive silver halide emulsion layers are provided, each of which contains a coupler. Chromogenic dyes formed of couplers contained in the respective layers exhibit spectral absorption maximums, each of which is preferably at least 20 nm apart from the other. As a preferred coupler, a cyan coupler, magenta coupler and yellow coupler are used. The combination of respective emulsion layers with couplers is usually combinations of a yellow coupler and a blue-sensitive layer, a magenta coupler and a green-sensitive layer, and a cyan coupler and a red-sensitive layer, but is not limited to these combinations and other combinations are applicable.

DIR compounds are used to constitute a color photographic material using the silver halide emulsion relating to the invention. Examples of DIR compounds usable in the invention include D-1 through D-34 described in JP-A No.

4-114153. In addition, there may be used DIR compounds described in U.S. Pat. Nos. 4,234,678, 3,227,554, 3,647,291, 3,958,993, 4,419,886, and 3,933,500; JP-A Nos. 57-56837, and 51-13239; U.S. Pat. Nos. 2,072,363, and 2,070,266; and RD40145 item XIV.

Examples of coupler usable in the construction of a color photographic material by using the emulsions of the invention are described in RD40145, item II. Additives usable in the construction of a color photographic material by using the emulsions of the invention can be incorporated by the dispersing method described in RD40145, item VIII. Commonly known supports described in RD38957, item XV can be used in the photographic material using the emulsions of the invention. The photographic material may be provided with an auxiliary layer such as a filter layer or an interlayer, as described in RD38957, item XI. There are applicable various layer configurations, such as conventional layer order, reverse layer order, or unit construction, as described in RD38957, item XI.

Silver halide emulsions relating to the invention are preferably applicable to various color photographic materials, such as color negative films for general use or for use in movie, color reversal films for slide or for television, color paper, color positive films and color reversal paper.

The photographic material using the emulsions of the invention can be processed using commonly known developers described in T. H. James "The Theory of The Photographic Process" Forth Edition, pp. 291–334; and J. Am. Chem. Soc. Vol. 73, pp. 3100 (1951), according to the conventional methods, as described in, cited above, RD38957, items XVII through XX and RD40145, item XXII.

EXAMPLES

The present invention will be exemplarily described based on examples but embodiments of the invention are by no means limited to these examples.

Example 1

Preparation of Tabular Seed Emulsion T-A

In accordance with the following procedure, tabular seed emulsion T-A was prepared.

Nucleation Process

A 28.8 lit. aqueous solution containing 162.8 g of oxidized gelatin A (methionine content of 0.3 μmol) and 23.6 g of potassium bromide was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01 and X-01 were added by double jet addition in one minute to perform nucleation and then, solution G-01 was further added thereto.

| | |
|---|---|
| S-01 Solution: | 205.7 ml of 1.25 mol/l aqueous silver nitrate solution, |
| X-01 Solution: | 205.7 ml of 1.25 mol/l aqueous potassium bromide solution, |
| G-01 Solution: | 2921 ml of aqueous solution containing 120.5 g of gelatin A and 8.8 ml of a 10% methanol solution of surfactant (A). |
| Surfactant A: | $HO(CH_2CH_2O)m[CH(CH_3)CH_2O]_2O(CH_2CH_2O)nH$ (m + n = 10) |

Ripening Process

After completion of the nucleation process, the temperature was raised to 60° C. in 45 min. and then, the pAg was adjusted to 9.0. Then, the reaction mixture was adjusted to a pH of 9.3 by adding 224.4 ml of an aqueous solution containing 29.2 g of ammonia and 709.3 ml of an aqueous potassium hydroxide solution, and after being maintained for 6 min., the pH was adjusted to 6.1.

Growth Process

After completion of the ripening process, solutions S-02 and X-02 were added by double jet addition at an accelerated flow rate (five times faster at the end than at the start), while maintaining the pAg at 9.0

| | |
|---|---|
| S-02 Solution: | 2620 ml of 1.25 mol/l aqueous silver nitrate solution, |
| X-01 Solution: | 2620 ml of 1.25 mol/l aqueous potassium bromide solution. |

After completion of addition of respective solutions, the resulting emulsion was desalted by the convention washing method, and alkali-processed inert gelatin B (methinine content of 50.0 μmol/g) was added thereto and dispersed. The thus obtained emulsion was denoted as seed emulsion T-A.

Preparation of Tabular Silver Halide Grain Emulsion Em-1

Subsequently, the foregoing tabular seed emulsion T-A was grown in accordance with the following procedure to prepare tabular grain emulsion Em-1, in which the mixing stirrer, as described in JP-A No. 62-160128 was used, and to remove soluble components from the reaction mixture by means of ultrafiltration was employed an apparatus described in JP-A No. 10-339923. Thus, to an aqueous 1% gelatin solution containing 0.123 mol. equivalent tabular seed emulsion T-A and 0.65 ml of a 10% methanol solution of the foregoing surfactant A, water and gelatin B were added to make 10 lit., then, the following solutions S-11 and X-11 were added by double jet addition at an accelerated flow rate (11 times faster at the end than at the start) over a period of 80 min., while soluble components in the reaction mixture were removed by ultrafiltration to maintain the reaction mixture at a constant volume.

| | |
|---|---|
| S-11 Solution: | 2432 ml of 1.75 mol/l aqueous silver nitrate solution, |
| X-11 Solution: | 2432 ml of 1.741 mol/l potassium bromide and 0.009 mol/l potassium iodide aqueous solution. |

The reaction mixture was further subjected to ultrafiltration over a period of 30 min. to remove 4.0 lit. of soluble components from the reaction mixture. Thereafter, the following solution S-12 was added thereto at a decreasing rate (0.28 time from start to finish) over a period of 17 min., followed by adjusting the pAg to 8.6.

| | |
|---|---|
| S-12 Solution: | 323 ml of 1.75 mol/l aqueous silver nitrate solution |

Subsequently, solutions I-11 and Z-11 were added and after adjusting to a pH of 9.3 and being maintained for 6 min., the pH was adjusted to 5.0 with an aqueous acetic acid solution and the pAg was adjusted to 9.4 with an aqueous potassium bromide solution:

| | |
|---|---|
| I-11 Solution: | aqueous solution containing 64.1 g of sodium p-iodoacetoamidobenzenesulfonate, |
| Z-11 Solution: | aqueous solution containing 22.2 g of sodium sulfite. |

Then, the following solutions S-13 and X-13 were added at an accelerated flow rate (2.3 times faster at the end than at the start) over a period of 15 min, while soluble components in the reaction mixture were removed by ultrafiltration to maintain the reaction mixture at a constant volume.

| | |
|---|---|
| S-13 Solution: | 363 ml of aqueous 1.75 mol/l silver nitrate solution, |
| X-13 Solution: | 509 ml of aqueous 1.663 mol/l potassium bromide and 0.088 mol/l potassium iodide solution. |

Thereafter, the following solution S-14 was added thereto at a decreasing rate (0.28 time from start to finish) over a period of 15 min., followed by adjusting the pAg to 8.4.

| | |
|---|---|
| S-14 Solution: | 242 ml of 1.75 mol/l aqueous silver nitrate solution |

Subsequently, the following solutions S-15 and X-15 were added by double jet addition at an accelerated flow rate (1.03 times fast at the end than at the start) over a period of 24 min., followed by adjusting the pAg to 9.4 with an aqueous potassium bromide solution. Then, the following solutions S-16 and X-16 were added by double jet addition at an accelerated flow rate (1.33 times fast at the end than at the start) over a period of 17 min.

| | |
|---|---|
| S-15 Solution: | 202 ml of aqueous 1.75 mol/l silver nitrate solution, |
| X-15 Solution: | 202 ml of aqueous 1.663 mol/l potassium bromide and 0.088 mol/l potassium iodide solution. |
| S-16 Solution: | 404 ml of aqueous 1.75 mol/l silver nitrate soution, |
| X-16 Solution: | 404 ml of aqueous 1.75 mol/l potassium bromide solution. |

After completion of addition, aqueous solution containing 120 g of chemically modified gelatin (in which the amino group was phenylcarbamoyled at a modification percentage of 95%) was added to perform desalting and washing, and then gelatin was further added and dispersed, followed by adjusting the pH and pAg to 5.8 and 8.9, respectively, at 40° C.

Tabular silver halide grain emulsion Em-1 was thus obtained. Analysis of emulsion Em-1 revealed that 81% of the total grain projection area was accounted for by tabular grains having aspect ratios of 10 to 50 and a mean equivalent circle diameter of 2.70 μm. A variation coefficient of equivalent circle diameter of total grains was 29.2%. It was further proved that 84% by number of the grains was accounted for by tabular grains having dislocation lines of 30 or more.

Preparation of Tabular Silver Halide Grain Emulsion Em-2

Tabular silver halide grain emulsion Em-2 was prepared similarly to the foregoing emulsion Em-1, except that prior to addition od solutions S-15 and X-15, solution M-11, as described below was added.

| | |
|---|---|
| M-11: | aqueous solution containing 88.2 mg of potassium hexacyanotellurium acid. |

Analysis of emulsion Em-2 revealed that 84% of the total grain projection area was accounted for by tabular grains having aspect ratios of 10 to 50 and a mean equivalent circle diameter of 2.67 μm. A variation coefficient of equivalent circle diameter of total grains was 28.0%. It was further proved that 82% by number of the grains was accounted for by tabular grains having dislocation lines of 30 or more.

Preparation of Tabular Silver Halide Grain Emulsion Em-3

Tabular silver halide grain emulsion Em-3 was prepared similarly to the foregoing emulsion Em-1, except that the pAg during addition of solutions S-11 and X-11 was maintained at 8.6 and the pAg during addition of solution S-12 was maintained at 8.6. Analysis of emulsion Em-3 revealed that 47% of the total grain projection area was accounted for by tabular grains having aspect ratios of 10 to 50 and a mean equivalent circle diameter of 2.30 μm. A variation coefficient of equivalent circle diameter of total grains was 26.5%. It was further proved that 80% by number of the grains was accounted for by tabular grains having dislocation lines of 30 or more.

Preparation of Tabular Silver Halide Grain Emulsion Em-4

Tabular silver halide grain emulsion Em-4 was prepared similarly to the foregoing emulsion Em-1, except that solutions I-11 and Z-11 were replaced by solutions I-12 and Z-12, respectively, as described below.

| | |
|---|---|
| I-12: | aqueous solution containing 16.0 g of sodium p-iodoacetomidobenzenesulfonate |
| Z-12: | aqueous solution containing 5.6 g of sodium sulfite |

Analysis of emulsion Em-4 revealed that 82% of the total grain projection area was accounted for by tabular grains having aspect ratios of 10 to 50 and a mean equivalent circle diameter of 2.71 μm. A variation coefficient of equivalent circle diameter of total grains was 29.1%. It was further proved that 35% by number of the grains was accounted for by tabular grains having dislocation lines of 30 or more.

Preparation of Tabular Silver Halide Grain Emulsion Em-5

Tabular silver halide grain emulsion Em-5 was prepared similarly to the foregoing emulsion Em-1, except solutions R-11 and T-11 described below were instantaneously added after completing addition of solution S-12 and after completing addition of solution S-15, respectively.

| | |
|---|---|
| R-11: | aqueous solution containing 10.6 mg thiourea dioxide |
| T-11: | aqueous solution containing 351.9 mg of sodium ethanethiosulfonate |

Analysis of emulsion Em-5 revealed that 80% of the total grain projection area was accounted for by tabular grains having aspect ratios of 10 to 50 and a mean equivalent circle diameter of 2.70 μm. A variation coefficient of equivalent circle diameter of total grains was 29.7%. It was further proved that 35% by number of the grains was accounted for by tabular grains having dislocation lines of 89 or more.

Preparation of Silver Halide Color Photographic Material

On a 120 μm thick, subbed triacetyl cellulose film support, the following layers having composition as shown below were formed to prepare a multi-layered color photographic material sample 101. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol.

| | |
|---|---|
| 1st Layer: Anti-Halation Layer | |
| Black colloidal silver | 0.16 |
| UV-1 | 0.30 |
| CM-1 | 0.12 |
| OIL-1 | 0.24 |
| Gelatin | 1.33 |
| 2nd Layer: Interlayer | |
| Silver iodobromide emulsion i | 0.06 |
| AS-1 | 0.12 |
| OIL-1 | 0.15 |
| Gelatin | 0.67 |
| 3rd Layer: Low-speed Red-Sensitive Layer | |
| Silver iodobromide emulsion h | 0.39 |
| Silver iodobromide emulsion e | 0.32 |
| SD-1 | $2.22 \times 10^{-4}$ |
| SD-2 | $3.72 \times 10^{-5}$ |
| SD-3 | $1.56 \times 10^{-4}$ |
| SD-4 | $3.41 \times 10^{-4}$ |
| C-1 | 0.77 |
| CC-1 | 0.006 |
| OIL-2 | 0.47 |
| AS-2 | 0.002 |
| Gelatin | 1.79 |
| 4th Layer: Medium-speed Red-sensitive Layer | |
| Silver iodobromide emulsion b | 0.83 |
| Silver iodobromide emulsion h | 0.36 |
| SD-12 | $1.60 \times 10^{-5}$ |
| SD-13 | $2.40 \times 10^{-4}$ |
| SD-1 | $4.80 \times 10^{-4}$ |
| C-1 | 0.42 |
| CC-1 | 0.072 |
| DI-1 | 0.046 |
| OIL-2 | 0.27 |
| AS-2 | 0.003 |
| Gelatin | 1.45 |
| 5th Layer: High-speed Red-Sensitive Layer | |
| Silver iodobromide emulsion a | 1.45 |
| Silver iodobromide emulsion e | 0.076 |
| SD-12 | $7.10 \times 10^{-6}$ |
| SD-13 | $1.10 \times 10^{-4}$ |
| SD-1 | $2.10 \times 10^{-4}$ |
| C-2 | 0.10 |
| C-3 | 0.17 |
| CC-1 | 0.013 |
| DI-4 | 0.024 |
| DI-5 | 0.022 |
| OIL-2 | 0.17 |
| AS-2 | 0.004 |
| Gelatin | 1.40 |
| 6th Layer: Interlayer | |
| Y-1 | 0.095 |
| AS-1 | 0.11 |
| OIL-1 | 0.17 |
| X-2 | 0.005 |
| Gelatin | 1.00 |
| 7th Layer: Low-speed Green-Sensitive Layer | |
| Silver iodobromide emulsion h | 0.32 |
| Silver iodobromide emulsion e | 0.11 |
| SD-5 | $3.24 \times 10^{-5}$ |
| SD-6 | $5.21 \times 10^{-4}$ |
| SD-7 | $1.25 \times 10^{-4}$ |
| SD-8 | $1.59 \times 10^{-4}$ |
| M-1 | 0.375 |
| CM-1 | 0.042 |

-continued

| | |
|---|---|
| DI-2 | 0.010 |
| OIL-1 | 0.41 |
| AS-2 | 0.002 |
| AS-3 | 0.11 |
| Gelatin | 1.24 |
| 8th Layer: Medium-speed Green-Sensitive Layer | |
| Silver iodobromide emulsion b | 0.66 |
| Silver iodobromide emulsion h | 0.11 |
| SD-5 | $2.14 \times 10^{-4}$ |
| SD-6 | $3.44 \times 10^{-4}$ |
| SD-7 | $1.73 \times 10^{-4}$ |
| SD-8 | $1.05 \times 10^{-4}$ |
| M-1 | 0.151 |
| CM-1 | 0.042 |
| CM-2 | 0.044 |
| DI-2 | 0.026 |
| DI-3 | 0.003 |
| OIL-1 | 0.27 |
| AS-3 | 0.046 |
| AS-4 | 0.006 |
| Gelatin | 1.22 |
| 9th Layer: High-speed Green-Sensitive Layer | |
| Silver iodobromide emulsion Em-1 | 1.24 |
| Silver iodobromide emulsion e | 0.066 |
| SD-5 | $2.12 \times 10^{-5}$ |
| SD-6 | $3.42 \times 10^{-4}$ |
| SD-8 | $1.04 \times 10^{-4}$ |
| M-1 | 0.038 |
| M-2 | 0.078 |
| CM-2 | 0.010 |
| DI-3 | 0.003 |
| OIL-1 | 0.22 |
| AS-2 | 0.007 |
| AS-3 | 0.035 |
| Gelatin | 1.38 |
| 10th Layer: Yellow Filter Layer | |
| Yellow colloidal silver | 0.053 |
| AS-1 | 0.15 |
| OIL-1 | 0.18 |
| Gelatin | 0.83 |
| 11th Layer: Low-speed Blue-sensitive Layer | |
| Silver iodobromide emulsion g | 0.23 |
| Silver iodobromide emulsion d | 0.11 |
| Silver iodobromide emulsion c | 0.11 |
| SD-9 | $1.14 \times 10^{-4}$ |
| SD-10 | $1.62 \times 10^{-4}$ |
| SD-11 | $4.39 \times 10^{-4}$ |
| Y-1 | 0.90 |
| DI-3 | 0.002 |
| OIL-1 | 0.29 |
| AS-2 | 0.0014 |
| X-1 | 0.10 |
| Gelatin | 1.79 |
| 12th Layer: High-sped Blue-sensitive Layer | |
| Silver iodobromide emulsion f | 1.34 |
| Silver iodobromide emulsion g | 0.25 |
| SD-9 | $4.11 \times 10^{-5}$ |
| SD-10 | $1.95 \times 10^{-5}$ |
| SD-11 | $1.59 \times 10^{-4}$ |
| Y-1 | 0.33 |
| DI-5 | 0.12 |
| OIL-1 | 0.17 |
| AS-2 | 0.010 |
| X-1 | 0.098 |
| Gelatin | 1.15 |
| 13th Layer: First Protective Layer | |
| Silver iodobromide emulsion i | 0.20 |
| UV-1 | 0.11 |
| UV-2 | 0.055 |
| X-1 | 0.078 |
| Gelatin | 0.70 |

-continued

| 14th Layer: Second protective Layer | |
|---|---|
| PM-1 | 0.13 |
| PM-2 | 0.018 |
| WAX-1 | 0.021 |
| Gelatin | 0.55 |

Characteristics of silver iodobromide emulsions used in sample 101, which were prepared in accordance with conventional method are shown below, wherein the average grain size refers to an edge length of a cube having the same volume as that of the grain.

| Emulsion | Av. Grain Size (μm) | Av. Iodide Content (mol %) | Diameter/thickness Ratio |
|---|---|---|---|
| a | 1.00 | 3.2 | 7.0 |
| b | 0.70 | 3.3 | 6.5 |
| c | 0.30 | 1.9 | 5.5 |
| d | 0.45 | 4.0 | 6.0 |
| e | 0.27 | 2.0 | Cubic |
| f | 1.20 | 8.0 | 5.0 |
| g | 0.75 | 8.0 | 4.0 |

-continued

| Emulsion | Av. Grain Size (μm) | Av. Iodide Content (mol %) | Diameter/thickness Ratio |
|---|---|---|---|
| h | 0.45 | 4.0 | 6.0 |
| i | 0.03 | 2.0 | 1.0 |

With regard to the foregoing emulsions, except for emulsion i, after adding the foregoing sensitizing dyes to each of the emulsions and ripening the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; dispersing aid SU-4; viscosity-adjusting agent V-1; stabilizer ST-1; two kinds polyvinyl pyrrolidone of weight-averaged molecular weights of 10,000 and 1.100,000 (AF-1, AF-2); calcium chloride; inhibitors AF-3, AF-4, AF-5, Af-6 and AF-7; hardener H-1; and antiseptic Ase-1.

Chemical structures for each of the compounds used in the foregoing sample are shown below.

Y-1

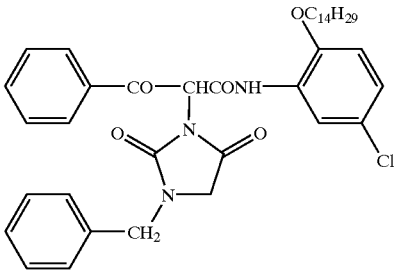

M-1

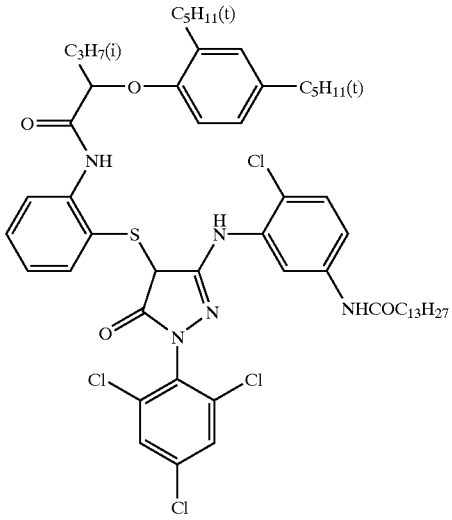

M-2

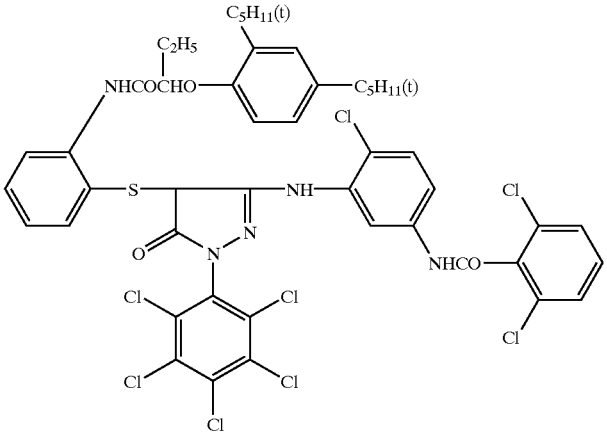

-continued
C-1
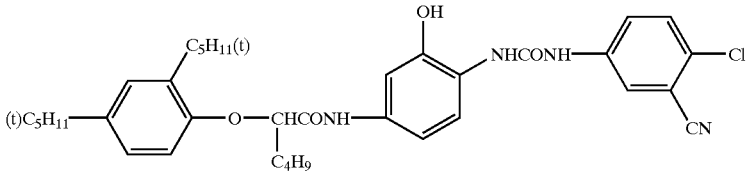
C-2
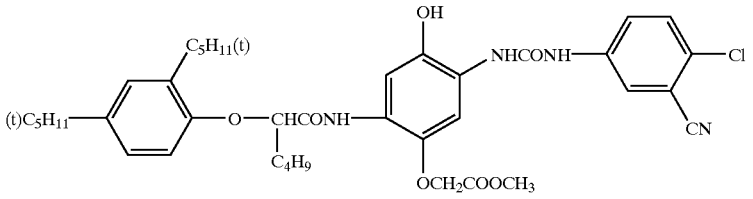
C-3
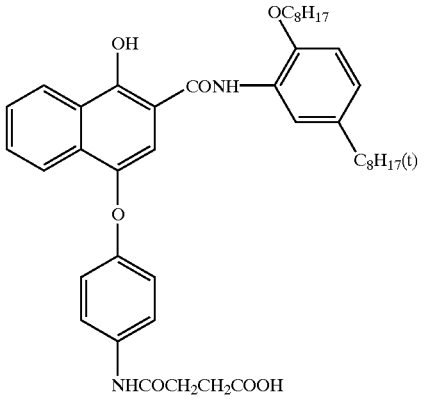
CC-1
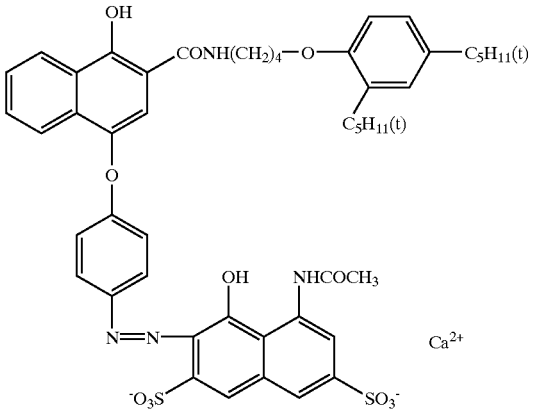
CM-1
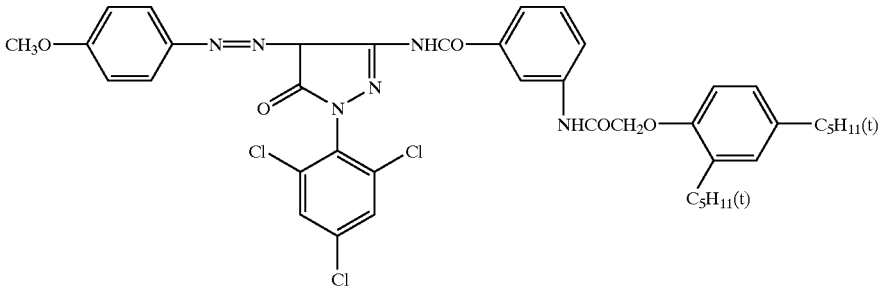
CM-2
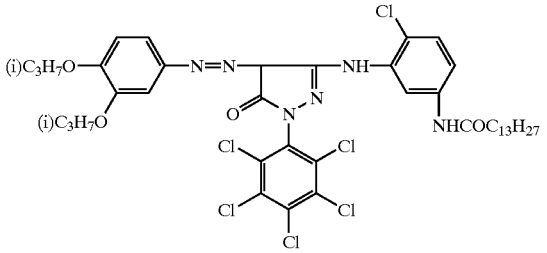
DI-1
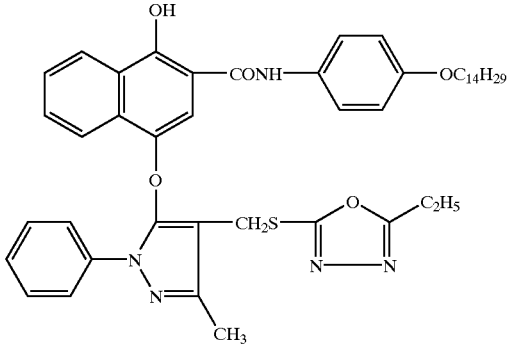

-continued
DI-2
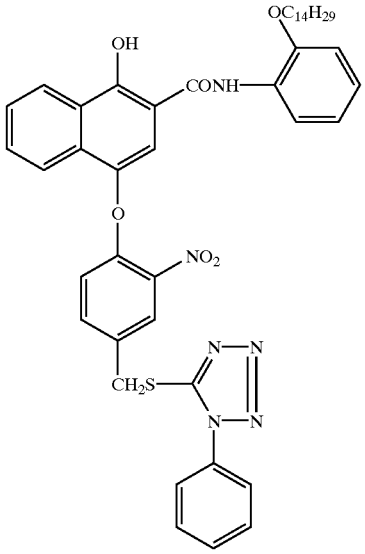
DI-3
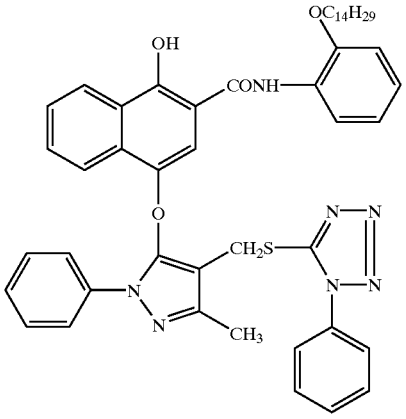
DI-4
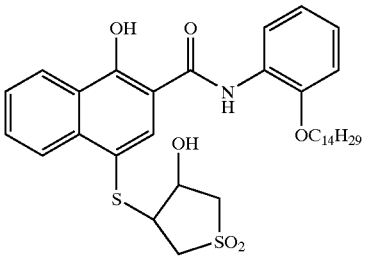
DI-5
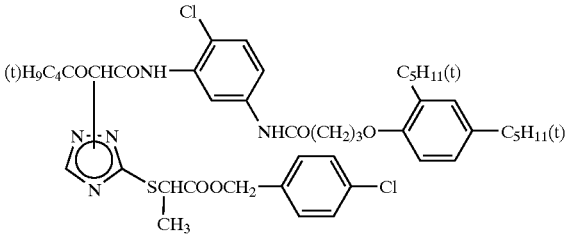
-continued
SD-1
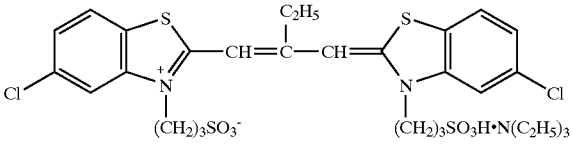
SD-2
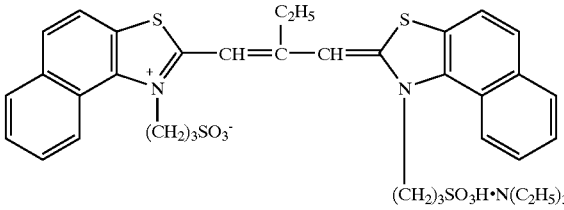
SD-3
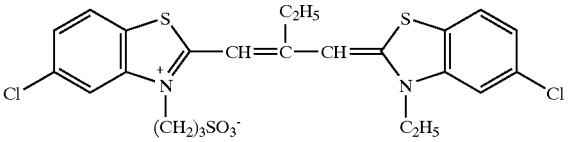
SD-4
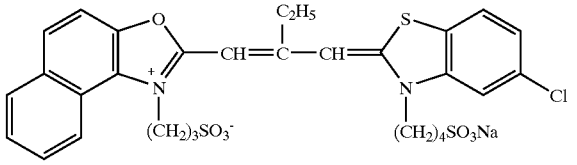
SD-5
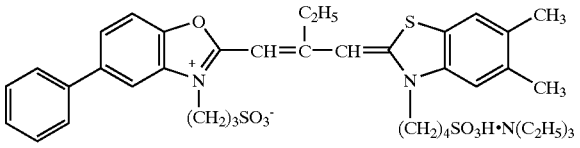
SD-6
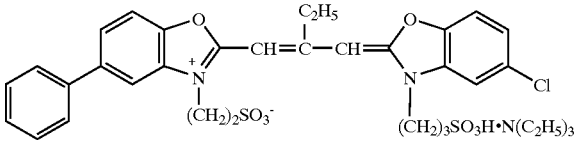

-continued
SD-7
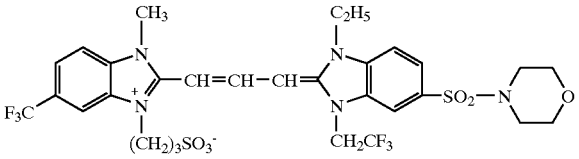
SD-8
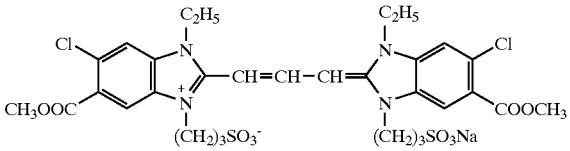
SD-9
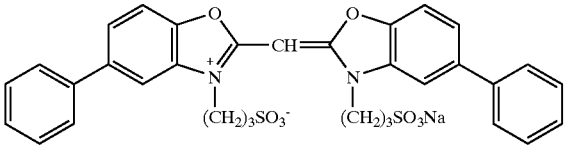
SD-10
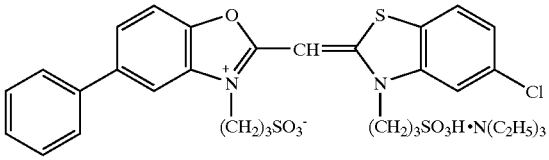
SD-11
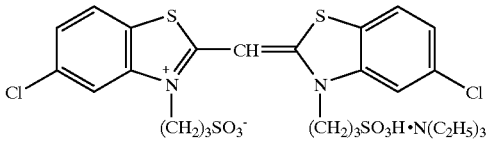
SD-12
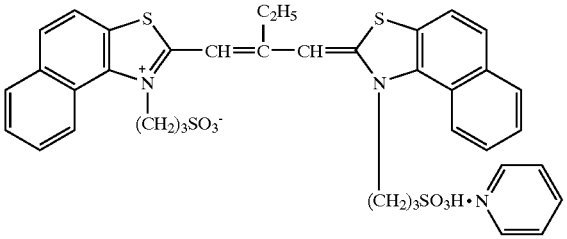
SD-13
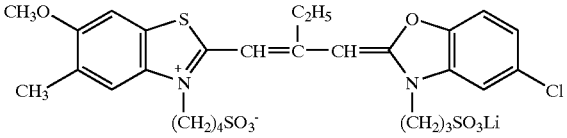
AS-1
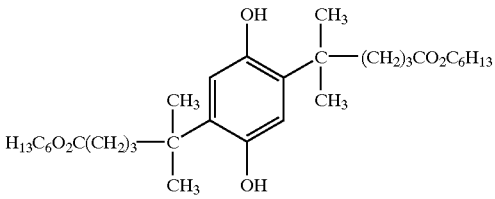
-continued
AS-2
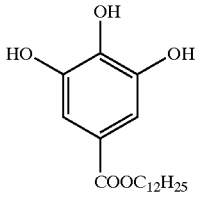
AS-3
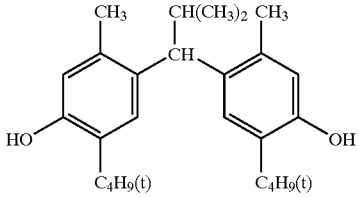
AS-4
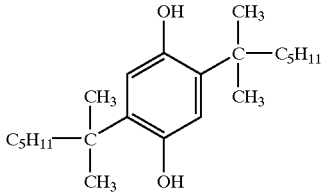
OIL-1
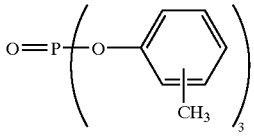
UV-1
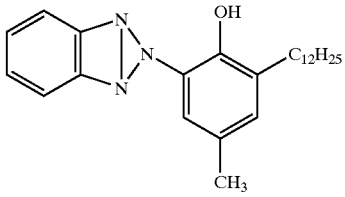
OIL-2
$H_9C_4OOC(CH_2)_8COOC_4H_9$
UV-2
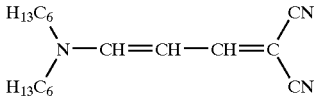
V-1
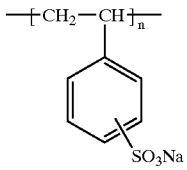
n: Degree of polymerization
Ase-1 (Mixture)
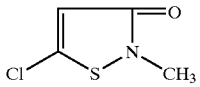
A
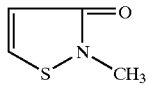
B -continued

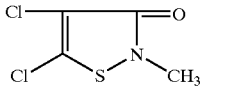

C

A:B:C = 50:46:4 (Molar ratio)

H-1

$CH_2{=}CHSO_2{-}CH_2CONHC_2H_4NHCOCH_2{-}SO_2CH{=}CH_2$

ST-1

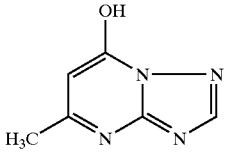

AF-1, 2

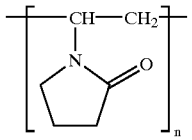

AF-1 Mw ≈ 10,000
AF-2 Mw ≈ 100,000 n: Degree of polymerization

AF-3

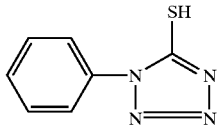

AF-4

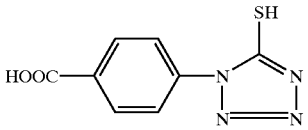

AF-5

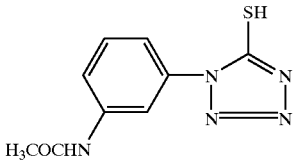

AF-6

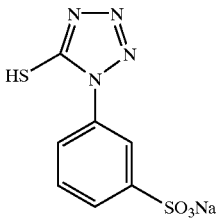

AF-7

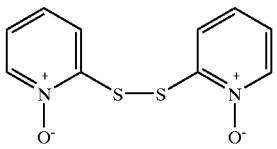

X-1

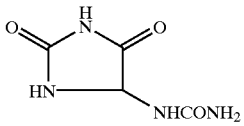

X-2

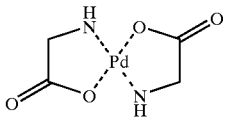

-continued

SU-1

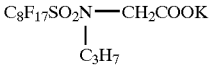

SU-2

$C_8F_{17}SO_2NH(CH_2)_3\overset{+}{N}(CH_3)_3Br^-$

SU-3

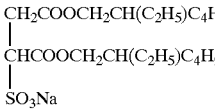

SU-4

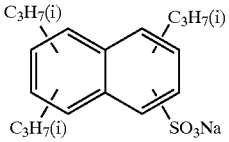

WAX-1

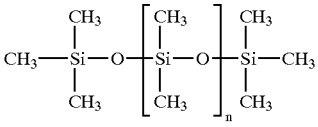

Mw = 3,000

PM-1

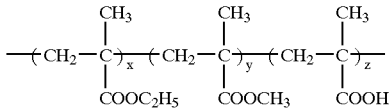

x:y:z = 3:3:4

PM-2

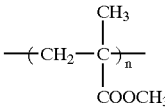

n: Degree of polymerization

Color photographic material samples 102 through 104, 210 through 204, 301 through 304, 401 through 404, and 501 through 504 were each prepared similarly to sample 101, except that emulsion Em-1 used in the $9^{th}$ layer was varied as shown in Table 1 and after completion of chemical sensitization of the emulsion, compounds, as shown in Table 1 were added.

Evaluation of Photographic Performance

The thus prepared samples were each exposed to white light through an optical stepped wedge at an exposure of 1.6 CMS for 1/200 sec. or 1 sec. and then processed in accordance with the color processing described in JP-A No. 10-123652, paragraph Nos. [0220] through [0227].

Processed samples were subjected to densitometry using green light to determine sensitivity. Sensitivity was defined as the reciprocal of exposure giving a density of 0.2 plus minimum density. The sensitivity obtained at an exposure of 1/200 sec was regarded as sensitivity at usual intensity and the sensitivity obtained at an exposure of 1 sec. was regarded as sensitivity at low intensity. These sensitivities were each represented by a relative value, based on the sensitivity of sample 101 being 100. Thus, a value more then 100 indicates a higher sensitivity and a preferable result. Results are shown in Table 1.

TABLE 1

| Sample No. | 9th Layer Emulsion | Compound (mol/Ag mol) | Compound* (mol/Ag mol) | Sensitivity 1/200 sec. | Sensitivity 1 sec. | Remark |
|---|---|---|---|---|---|---|
| 101 | Em-1 | — | — | 100 | 100 | Comp. |
| 102 | Em-1 | T-25 ($2.8 \times 10^{-2}$) | — | 120 | 125 | Inv. |
| 103 | Em-1 | T-25 ($2.8 \times 10^{-2}$) | HB3 ($1.3 \times 10^{-2}$) | 124 | 126 | Inv. |
| 104 | Em-1 | T-36 ($2.3 \times 10^{-5}$) | HB3 ($1.3 \times 10^{-2}$) | 121 | 126 | Inv. |
| 105 | Em-1 | T-49 ($2.3 \times 10^{-5}$) | HB3 ($1.3 \times 10^{-2}$) | 128 | 124 | Inv. |
| 201 | Em-2 | — | — | 111 | 98 | Comp. |
| 202 | Em-2 | T-25 ($2.8 \times 10^{-2}$) | — | 138 | 153 | Inv. |
| 203 | Em-2 | T-25 ($2.8 \times 10^{-2}$) | HB3 ($1.3 \times 10^{-2}$) | 141 | 155 | Inv. |
| 204 | Em-2 | T-36 ($2.3 \times 10^{-5}$) | HB3 ($1.3 \times 10^{-2}$) | 139 | 154 | Inv. |
| 205 | Em-2 | T-49 ($2.3 \times 10^{-5}$) | HB3 ($1.3 \times 10^{-2}$) | 138 | 154 | Inv. |
| 301 | Em-3 | — | — | 85 | 83 | Comp. |
| 302 | Em-3 | T-25 ($2.8 \times 10^{-2}$) | — | 88 | 82 | Comp. |
| 303 | Em-3 | T-25 ($2.8 \times 10^{-2}$) | HB3 ($1.3 \times 10^{-2}$) | 91 | 82 | Comp. |
| 304 | Em-3 | T-36 ($2.3 \times 10^{-5}$) | HB3 ($1.3 \times 10^{-2}$) | 89 | 83 | Comp. |
| 305 | Em-3 | T-49 ($2.3 \times 10^{-5}$) | HB3 ($1.3 \times 10^{-2}$) | 92 | 79 | Comp. |
| 401 | Em-4 | — | — | 79 | 81 | Comp. |
| 402 | Em-4 | T-25 ($2.8 \times 10^{-2}$) | — | 80 | 80 | Comp. |
| 403 | Em-4 | T-25 ($2.8 \times 10^{-2}$) | HB3 ($1.3 \times 10^{-2}$) | 81 | 79 | Comp. |
| 404 | Em-4 | T-36 ($2.3 \times 10^{-5}$) | HB3 ($1.3 \times 10^{-2}$) | 83 | 81 | Comp. |
| 405 | Em-4 | T-49 ($2.3 \times 10^{-5}$) | HB3 ($1.3 \times 10^{-2}$) | 84 | 79 | Comp. |
| 501 | Em-5 | — | — | 101 | 102 | Comp. |
| 502 | Em-5 | T-25 ($2.8 \times 10^{-2}$) | — | 130 | 140 | Inv. |
| 503 | Em-5 | T-25 ($2.8 \times 10^{-2}$) | HB3 ($1.3 \times 10^{-2}$) | 135 | 148 | Inv. |
| 504 | Em-5 | T-36 ($2.3 \times 10^{-5}$) | HB3 ($1.3 \times 10^{-2}$) | 130 | 138 | Inv. |
| 505 | Em-5 | T-49 ($2.3 \times 10^{-5}$) | HB3 ($1.3 \times 10^{-2}$) | 127 | 141 | Inv. |

*Hydroxybenzene compound.

As can be seen from the results in Table 1, it was proved that photographic material samples according to the invention exhibited higher sensitivity at ordinary intensity exposure and enhanced sensitivity at low intensity exposure.

What is claimed is:

1. A silver halide emulsion comprising silver halide grains, wherein at least 50% of total grain projected area is accounted for by tabular grains having an aspect ratio of 10 to 100 and at least 50% by number of total grains is accounted for by tabular grains having at least 30 dislocation lines per grain in the fringe portion of the grain, and the emulsion contains a compound having a function of permitting injection of at least two electrons into silver halide via photoexcitation by a single photon wherein said compound having a function of permitting injection of at least two electrons into silver halide via photoexcitation by a single photon is an organic compound capable of forming an (m+n)-valent cation from an n-valent cation radical with an intramolecular cyclization reaction, in which n and m are each an integer of 1 or more.

2. The silver halide emulsion of claim 1, wherein said compound having a function of permitting injection of at least two electrons into silver halide via photoexcitation by a single photon is a compound forming a bivalent cation from a univalent cation radical with an intramolecular cyclization reaction.

3. The silver halide emulsion of claim 1, wherein said organic compound capable of forming an (m+n)-valent cation from an n-valent cation radical with an intramolecular cyclization reaction is represented by the following formula (1), (2) or (3):

$$A^1—X^1—B^1—X^2—A^2 \qquad \text{formula (1)}$$

wherein $X^1$ and $X^2$ are each independently N, P, S, Se or Te; $A^1$ and $A^2$ are each independently a substituent; and $B^1$ is a bivalent linkage group;

formula (2)

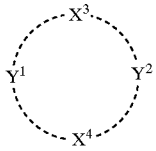

wherein $X^3$ and $X^4$ are each independently N, P, S, Se or Te; $Y^1$ and $Y^2$ are each an atomic group necessary to form together with $X^3$ or $X^4$ a 6- to 12-membered ring;

$$(Z—)_{k1}—[—(—L—)_{k3}—X]_{k2} \qquad \text{formula (3)}$$

wherein Z is an adsorption group onto silver halide or light absorbing group; L is a bivalent linkage group; X is a group having a moiety structure of the compound capable of forming a (m+n)-valent cation from an n-valent cation radical with an intramolecular cyclization reaction, a group having a moiety structure of formula (1) or a group having a moiety structure of formula (2): k1 is an integer of 1 through 4, k2 is an integer of 1 through 4, and k3 is 0 or 1.

4. The silver halide emulsion of claim 1, wherein the emulsion further contains a hydroxybenzene compound.

5. The silver halide emulsion of claim 1, wherein the silver halide grains have a shallow electron trap in the interior of the grains.

6. The silver halide emulsion of claim 1, wherein the silver halide grains have a hole trap center in the interior of the grains.

7. The silver halide emulsion of claim 1, wherein the silver halide emulsion further comprises a gelatin having a methionine content of less than 30 $\mu$mol per gram.

8. The silver halide emulsion of claim 1, wherein said compound is one selected from the group consisting of the following compounds T-1 through T-54:

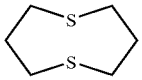
T-1
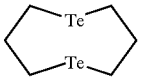
T-2
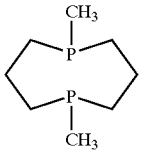
T-3
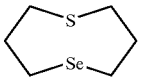
T-4
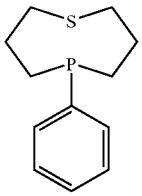
T-5
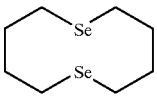
T-6
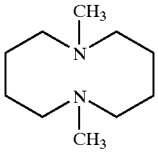
T-7
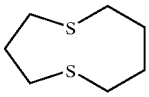
T-8
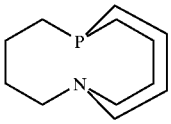
T-9
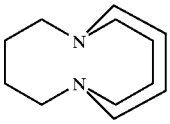
T-10
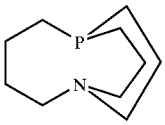
T-11
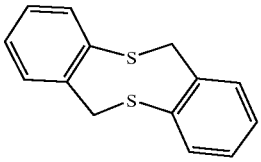
T-12
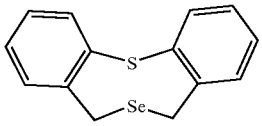
T-13
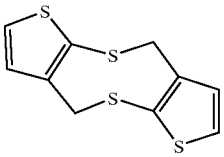
T-14
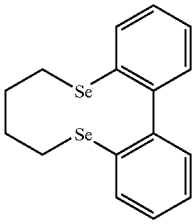
T-15
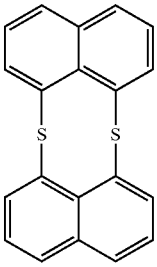
T-16
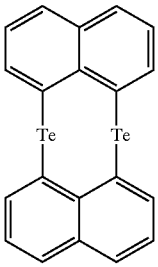
T-17
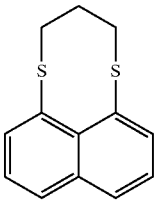
T-18

-continued
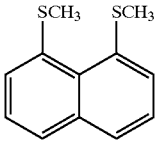
T-19
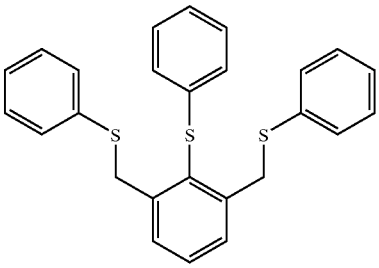
T-20
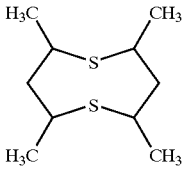
T-21
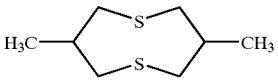
T-22
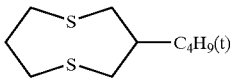
T-23
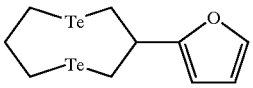
T-24
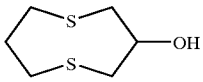
T-25
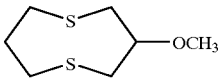
T-26
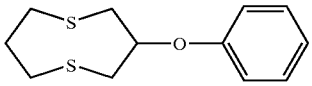
T-27
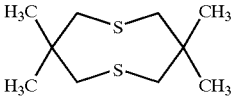
T-28
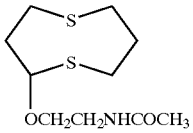
T-29
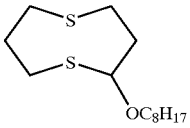
T-30
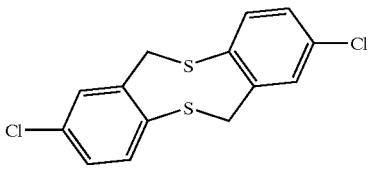
T-31
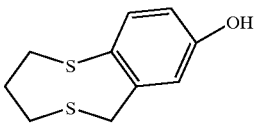
T-32
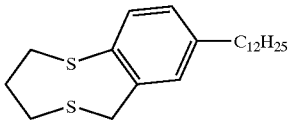
T-33
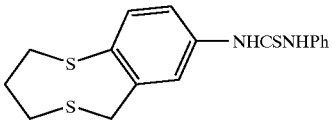
T-34
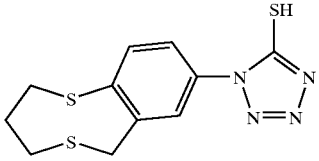
T-35
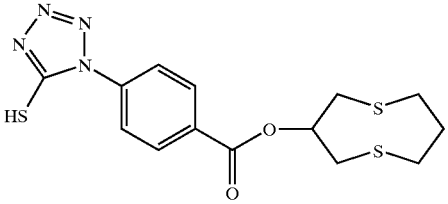
T-36
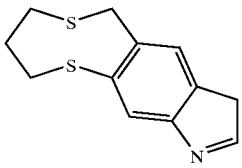
T-37
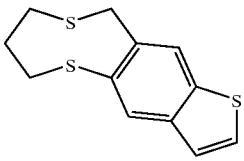
T-38

-continued
T-39
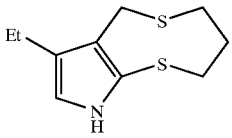
T-40
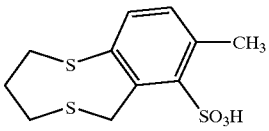
T-41
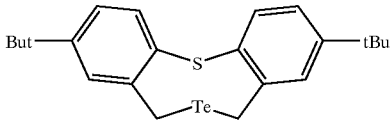
T-42
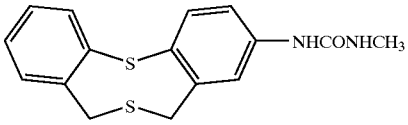
T-43
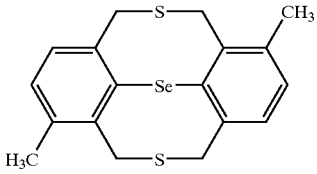
T-44
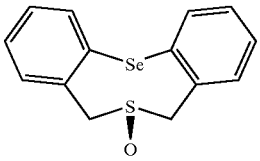
T-45
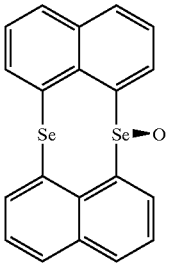
T-46
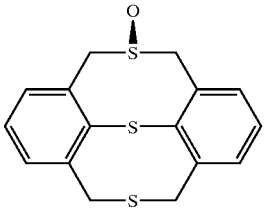
T-47
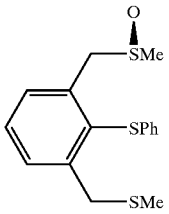
T-48
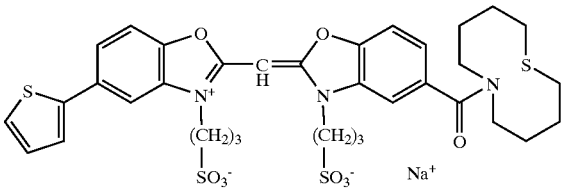
T-49
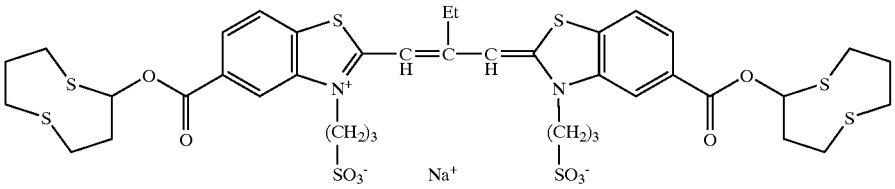
T-50
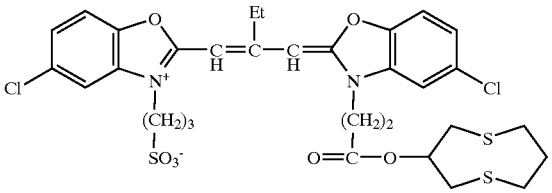
T-51
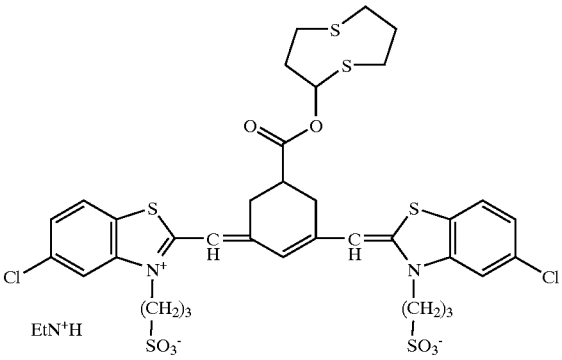

-continued
T-52
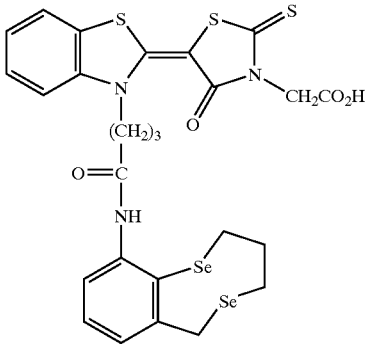
T-53
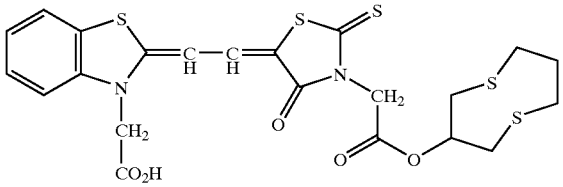
T-54
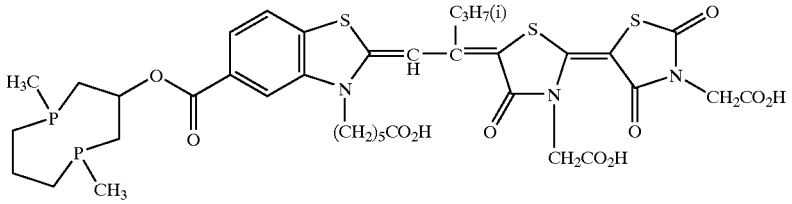
* * * * *